US012799667B2

(12) United States Patent
Choi et al.

(10) Patent No.: US 12,799,667 B2
(45) Date of Patent: Nov. 17, 2026

(54) DRYER AND METHOD FOR CONTROLLING THE SAME

(71) Applicant: SAMSUNG ELECTRONICS CO., LTD., Suwon-si (KR)

(72) Inventors: Jinsoo Choi, Suwon-si (KR); Taedong Goh, Suwon-si (KR); Minhee Kim, Suwon-si (KR); Bohwan Choi, Suwon-si (KR); Youngho Ryu, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 299 days.

(21) Appl. No.: 18/640,834

(22) Filed: Apr. 19, 2024

(65) Prior Publication Data

US 2025/0011999 A1 Jan. 9, 2025

Related U.S. Application Data

(63) Continuation of application No. PCT/KR2024/004131, filed on Apr. 1, 2024.

(30) Foreign Application Priority Data

Jul. 3, 2023 (KR) ..... 10-2023-0086111
Oct. 18, 2023 (KR) ..... 10-2023-0139921

(51) Int. Cl.
*D06F 58/36* (2020.01)
*D06F 34/10* (2020.01)
(Continued)

(52) U.S. Cl.
CPC ..... *D06F 58/38* (2020.02); *D06F 34/10* (2020.02); *D06F 34/18* (2020.02); *D06F 34/20* (2020.02);
(Continued)

(58) Field of Classification Search
CPC ..... D06F 58/02; D06F 58/36; D06F 58/38; D06F 58/50; D06F 58/52; D06F 34/14; D06F 34/15; D06F 34/18
(Continued)

(56) References Cited

U.S. PATENT DOCUMENTS 8,943,705 B2 2/2015 Wisherd et al.
10,563,343 B2 2/2020 Chung et al.
(Continued)

FOREIGN PATENT DOCUMENTS

EP 3 964 637 A1 3/2022
JP 5217993 B2 6/2013
(Continued)

OTHER PUBLICATIONS

International Search Report (PCT/ISA/210) issued on Jul. 22, 2024 by the International Searching Authority in International Application No. PCT/KR2024/004131.
(Continued)

*Primary Examiner* — Deming Wan
(74) *Attorney, Agent, or Firm* — Sughrue Mion, PLLC

(57) ABSTRACT

A dryer may include a cabinet; a drum configured to rotate in the cabinet; a plurality of electrodes, between the drum and the cabinet, spaced apart from each other along a circumference of the drum; a radio frequency (RF) power supply configured to apply a voltage to the plurality of electrodes; and a controller configured to control the RF power supply to generate, via the plurality of electrodes, an electric field for dielectric heating of an object to be dried in the drum.

20 Claims, 20 Drawing Sheets

(51) Int. Cl.

| | |
|---|---|
| ***D06F 34/14*** | (2020.01) |
| ***D06F 34/16*** | (2020.01) |
| ***D06F 34/18*** | (2020.01) |
| ***D06F 34/20*** | (2020.01) |
| ***D06F 58/02*** | (2006.01) |
| ***D06F 58/26*** | (2006.01) |
| ***D06F 58/38*** | (2020.01) |
| ***D06F 58/50*** | (2020.01) |
| ***D06F 58/52*** | (2020.01) |
| *D06F 103/04* | (2020.01) |
| *D06F 103/24* | (2020.01) |
| *D06F 103/44* | (2020.01) |
| *D06F 105/28* | (2020.01) |

(52) U.S. Cl.
CPC ..... *D06F 58/02* (2013.01); *D06F 58/26* (2013.01); *D06F 2103/04* (2020.02); *D06F 2103/24* (2020.02); *D06F 2103/44* (2020.02); *D06F 2105/28* (2020.02)

(58) Field of Classification Search
USPC ..... 34/261, 318, 499
See application file for complete search history.

(56) References Cited

U.S. PATENT DOCUMENTS

| | | | | |
|---|---|---|---|---|
| 11,680,360 | B2 | 6/2023 | D'Anna et al. | |
| 11,937,360 | B2 | 3/2024 | Uno et al. | |
| 2007/0045307 | A1 | 3/2007 | Tsui et al. | |
| 2009/0211108 | A1* | 8/2009 | Moschutz | D06F 58/04 34/88 |
| 2015/0322611 | A1 | 11/2015 | Ashrafzadeh et al. | |
| 2020/0232142 | A1* | 7/2020 | Uluag | D06F 34/10 |
| 2021/0206188 | A1* | 7/2021 | Shimanaka | B41N 1/04 |
| 2022/0074113 | A1 | 3/2022 | Kim et al. | |
| 2022/0325463 | A1 | 10/2022 | Kim et al. | |

FOREIGN PATENT DOCUMENTS

| | | | |
|---|---|---|---|
| JP | 2022-1159 | A | 1/2022 |
| JP | 2022-55649 | A | 4/2022 |
| KR | 10-2005-0017872 | A | 2/2005 |
| KR | 10-2007-0017884 | A | 2/2007 |
| KR | 10-2018-0085201 | A | 7/2018 |
| KR | 10-2021-0006183 | A | 1/2021 |
| KR | 10-2021-0087388 | A | 7/2021 |
| KR | 10-2022-0032174 | A | 3/2022 |
| WO | 2020/027240 | A1 | 2/2020 |
| WO | 2021186887 | A1 | 9/2021 |

OTHER PUBLICATIONS

Written Opinion (PCT/ISA/237) issued on Jul. 22, 2024 by the International Searching Authority in International Application No. PCT/KR2024/004131.

Communication dated Jun. 29, 2026, issued by the European Patent Office in counterpart European Application No. 24836147.9.

* cited by examiner

90 : 90a, 90b, 90c

90 : 90d, 90e, 90f, 90g, 90h, 90i

90 : 90j, 90k, 90l, 90m, 90n, 90o, 90p, 90q, 90r $\angle\theta p = \theta a - \theta b = \theta b - \theta c = \theta c - \theta a$ $\Delta\theta p = \theta d - \theta e = \theta e - \theta f = \theta f - \theta g = \theta g - \theta h = \theta h - \theta i = \theta i - \theta d$ $\Delta\theta p = \theta d - \theta e = \theta e - \theta f = \theta f - \theta g = \theta g - \theta h = \theta h - \theta i = \theta i - \theta d$ $\Delta\theta p = \theta d - \theta e = \theta e - \theta f = \theta f - \theta g = \theta g - \theta h = \theta h - \theta i = \theta i - \theta d$ $V_b > V_a = V_c$

DRYER AND METHOD FOR CONTROLLING THE SAME

CROSS-REFERENCE TO RELATED APPLICATIONS

This application is a bypass continuation of International Application No. PCT/KR2024/004131, filed on Apr. 1, 2024, which claims priority under 35 U.S.C. § 119 to Korean Patent Application No. 10-2023-0086111, filed on Jul. 3, 2023, in the Korean Intellectual Property Office, and Korean Patent Application No. 10-2023-0139921, filed on Oct. 18, 2023, in the Korean Intellectual Property Office, the disclosures of which are incorporated by reference herein in their entireties.

BACKGROUND

1. Technical Field

Embodiments of the present disclosure relate to a dryer that may dry an object to be dried through dielectric heating, and a method for controlling the same.

2. Brief Description of Related Art

A dryer is a device capable of drying an object to be dried by removing moisture contained in the object. There are many different types of drying de vices. For example, there are dryers that supply hot air to the inside of a drum accommodating an object to be dried. In the case of the method of supplying hot air into the drum, heat is transferred from air with a low specific heat to water with a high specific heat, resulting in low heat transfer efficiency and, consequently, low drying efficiency. In addition, the high temperature air supplied to the drum may damage the object to be dried.

In another example, there are dryers capable of drying an object to be dried through dielectric heating using radio frequency (RF). In existing drying devices using dielectric heating, the water contained in an object to be dried is heated by placing the object between two flat electrodes arranged in parallel and generating an electric field between the two flat electrodes. In existing dryers, an electric field is generated in only one direction, and thus an object to be dried may not be effectively heated when the object is moving.

SUMMARY

According to embodiments the present disclosure, a dryer and a method for controlling the same may be provided and may change a location of an electric field concentration area for dielectric heating by monitoring a distribution of an object to be dried in a drum.

According to embodiments of the present disclosure, a dryer and a method for controlling the same may be provided, may generate at least one electric field concentration area, and may adjust a size of the at least one electric field concentration area in consideration of the amount of an object to be dried, a movement of the object, and an eccentricity of the object.

According to an embodiment of the disclosure, a dryer 1 may include: a cabinet; a drum configured to rotate in the cabinet; a plurality of electrodes, between the drum and the cabinet, spaced apart from each other along a circumference of the drum; a radio frequency (RF) power supply 120 configured to apply a voltage to the plurality of electrodes; and a controller 200 configured to control the RF power supply to generate, via the plurality of electrodes, an electric field for dielectric heating of an object to be dried in the drum.

The controller may be configured to obtain distribution information of the object in the drum based on at least one from among a vibration pattern of the drum and magnitudes of voltages detected at each of the plurality of electrodes. The controller may be configured to determine a phase difference of voltages to be applied to each of two adjacent electrodes of the plurality of electrodes based on the distribution information of the object. The controller may be configured to control the RF power supply to apply multi-phase voltages to the plurality of electrodes, based on the phase difference of the voltages applied to the each of the two adjacent electrodes.

According to an embodiment of the disclosure, a method for controlling a dryer may include: obtaining, by a controller, distribution information of an object to be dried in a drum based on at least one from among a vibration pattern of the drum and magnitudes of voltages detected at each of a plurality of electrodes; determining, by the controller, a phase difference of voltages to be applied to each of two adjacent electrodes from among the plurality of electrodes based on the distribution information of the object; and controlling an RF power supply to apply multi-phase voltages to the plurality of electrodes, based on the phase difference of the voltages to be applied to the two adjacent electrodes, so as to generate an electric field for dielectric heating of the object while the drum rotates.

According to embodiment of the present disclosure, a non-transitory computer-readable medium storing computer instructions may be provided. The computer instructions may be configured to, when executed by at least one processor, cause the at least one processor to perform the method for controlling the dryer.

According to embodiments of the present disclosure, a dryer and a method for controlling the same may be provided and may change a location of an electric field concentration area for dielectric heating by monitoring a distribution of an object to be dried in a drum. In addition, the dryer and the method for controlling the same may generate at least one electric field concentration area and may adjust a size of the at least one electric field concentration area in consideration of the amount of the object, a movement of the object, and an eccentricity of the object. Thus, a drying efficiency by dielectric heating may be improved.

DETAILED DESCRIPTION

Figure 1:
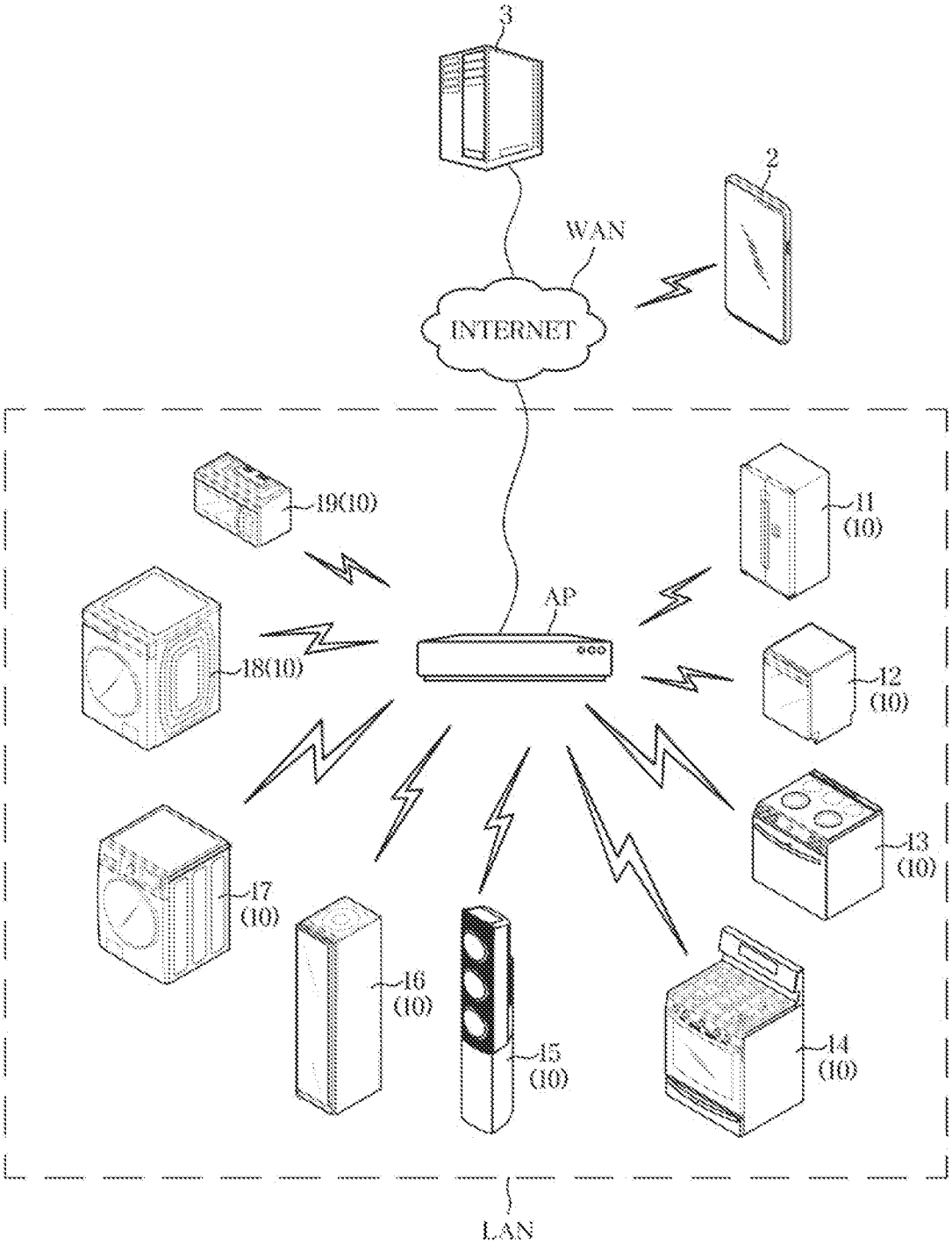
FIG. 1 illustrates a network system implemented by various electronic devices.

Various example embodiments of the present disclosure and terms used herein are not intended to limit the technical features described in the present disclosure to particular embodiments, and the present disclosure should be construed as including various modifications, equivalents, and alternatives of a corresponding embodiment.

With regard to description of drawings, similar reference numerals may be used for similar or related components.

A singular form of a noun corresponding to an item may include one item or a plurality of the items unless context clearly indicates otherwise.

As used herein, each of the expressions "A or B," "at least one of A and B," "at least one of A or B," "A, B, or C," "at least one of A, B, and C," and "at least one of A, B, or C," may include one or all possible combinations of the items listed together with a corresponding expression among the expressions.

It will be understood that the terms "first", "second", etc., may be used only to distinguish one component from other components, and are not intended to limit the corresponding component in other aspects (e.g., importance or order).

It may be said that one (e.g., first) component is "coupled" or "connected" to another (e.g., second) component, with or without the terms "functionally" "communicatively". In such case, it means that one component can be connected to the another component directly (e.g., by wire), wirelessly, or through a third component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

An expression that one component is "connected", "coupled", "supported", or "in contact" with another component includes a case in which the components are directly "connected", "coupled", "supported", or "in contact" with each other and a case in which the components are indirectly "connected", "coupled", "supported", or "in contact" with each other through a third component.

It will also be understood that when one component is referred to as being "on" or "over" another component, it can be directly on the other component or intervening components may also be present.

The term "and/or" includes any and all combinations of one or more of a plurality of associated listed items.

Hereinafter, non-limiting example embodiments of the present disclosure are described in detail with reference to the accompanying drawings.

FIG. 1 illustrates a network system implemented by various electronic devices.

Referring to FIG. 1, a home appliance 10 may include a communication module capable of communicating with another home appliance, a user device 2, and/or a server 3; a user interface receiving a user input or outputting information to a user; at least one processor controlling an operation of the home appliance 10; and at least one memory storing a program for controlling an operation of the home appliance 10.

The home appliance 10 may be at least one from among various types of electronic devices. For example, the home appliance 10 may include at least one from among a refrigerator 11, a dishwasher 12, an electric range 13, an electric oven 14, an air conditioner 15, a clothing care apparatus 16, a washing machine 17, a dryer 18, and a microwave oven 19.

The home appliance 10 is not limited to those shown in FIG. 1. For example, the home appliance 10 may include a variety of electronic devices, such as a robot cleaner, a vacuum cleaner, or a television. Also, the aforementioned home appliances are only examples, and in addition to the aforementioned home appliances, other types of electronic devices connected to another home appliance, the user device 2 and/or the server 3 to perform the below-described operations may be included as the home appliance 10.

The server 3 may include a communication module communicating with another server, the user device 2, and/or the home appliance 10; at least one processor processing data received from the other server, the user device 2, and/or the home appliance 10; and at least one memory storing programs for processing data or processed data. The server 3 may be implemented as a variety of computing devices, such as a workstation, a cloud, a data drive, a data station, and the like. The server 3 may be implemented as one or more servers physically or logically separated based on a function, detailed configuration of function, or data, and may transmit and receive data through communication between servers and process the transmitted and received data.

The server 3 may perform functions such as managing a user account, registering the home appliance 10 in association with the user account, and managing or controlling the registered home appliance 10. For example, a user may access the server 3 via the user device 2 and may generate a user account. The user account may be identified by an identifier (ID) and a password set by the user. The server 3 may register the home appliance 10 to the user account according to a predetermined procedure. For example, the server 3 may link identification information of the home appliance 10 (e.g., a serial number or MAC address) to the user account to register, manage, and control the home appliance 10. The user device 2 may include a communication module capable of communicating with the server 3 and/or the home appliance 10; a user interface receiving a user input or outputting information to a user; at least one processor controlling an operation of the user device 2; and at least one memory storing a program for controlling the operation of the user device 2.

The user device 2 may be carried by a user, or placed in a user's home or office, or the like. The user device 2 may include a personal computer, a terminal, a portable telephone, a smartphone, a handheld device, a wearable device, a display, and the like, without being limited thereto.

The memory of the user device 2 may store a program for controlling the home appliance 10, i.e., an application. The application may already be installed on the user device 2 when the user device 2 is sold, or may be downloaded from an external server for installation.

By executing the application installed on the user device 2 by a user, the user may access the server 3, generate a user account, and perform communication with the server 3 based on the login user account to register the home appliance 10.

For example, by operating the home appliance 10 to enable the home appliance 10 to access the server 3 according to a procedure guided by the application installed on the user device 2, the server 3 may register the home appliance 10 with the user account by assigning the identification information (e.g., a serial number or MAC address) of the home appliance 10 to the corresponding user account.

A user may control the home appliance 10 using the application installed on the user device 2. For example, by logging into a user account with the application installed on the user device 2, the home appliance 10 registered in the user account appears, and by inputting a control command for the home appliance 10, the user device 2 may transmit a control command to the home appliance 10 via the server 3.

A network may include both a wired network and a wireless network. The wired network may include a cable network or a telephone network, and the wireless network may include any networks transmitting and receiving a signal via radio waves. The wired network and the wireless network may be connected to each other.

The network may include a wide area network (WAN), such as the Internet, a local area network (LAN) formed around an access point (AP), and a short range wireless network not using an AP. The short range wireless network may include Bluetooth™ (institute of electrical and electronics engineers (IEEE) 802.15.1), Zigbee (IEEE 802.15.4), wireless fidelity (Wi-Fi) direct, near field communication (NFC), and Z-Wave, without being limited thereto.

The AP may connect the user device 2 and/or the home appliance 10 to a WAN connected to the server 3. The user device 2 and/or the home appliance 10 may be connected to the server 3 via a WAN.

The AP may communicate with the user device 2 or the home appliance 10 using wireless communication, such as Wi-Fi™ (IEEE 802.11), Bluetooth™ (IEEE 802.15.1), Zigbee (IEEE 802.15.4), or the like, and access a WAN using wired communication, without being limited thereto.

According to various embodiments of the present disclosure, the home appliance 10 may be directly connected to the user device 2 and/or the server 3, without going through an AP.

The home appliance 10 may be connected to the user device 2 and/or the server 3 via a long range wireless network or a short range wireless network.

For example, the home appliance 10 may be connected to the user device 2 via a short range wireless network (e.g., wi-fi direct).

In another example, the home appliance 10 may be connected to the user device 2 and/or the server 3 via a WAN using a long range wireless network (e.g., a cellular communication module).

In still another example, the home appliance 10 may access a WAN using wired communication, and may be connected to the user device 2 and/or the server 3 via a WAN.

In a case where the home appliance 10 may access a WAN using wired communication, the home appliance 10 may also act as an access point. Accordingly, the home appliance 10 may connect another home appliance to the WAN to which the server 3 is connected. Also, the other home appliance may connect the home appliance 10 to the WAN to which the server 3 is connected.

The home appliance 10 may transmit information about an operation or state to the user device 2, the server 3, and/or another home appliance via the network. For example, the home appliance 10 may transmit information about an operation or state to the user device 2, the server 3, and/or the other home appliance upon receiving a request from the server 3, in response to an event in the home appliance 10, or periodically or in real time. In response to receiving the information about the operation or state from the home appliance 10, the server 3 may update the stored information about the operation or state of the home appliance 10, and may transmit the updated information about the operation and state of the home appliance 10 to the user device 2 via the network. Here, updating the information may include various operations in which existing information is changed, such as adding new information to the existing information, replacing the existing information with new information, and the like.

The home appliance 10 may obtain various information from the user device 2, the server 3, and/or the other home appliance, and may provide the obtained information to a user. For example, the home appliance 10 may obtain information related to a function of the home appliance 10 (e.g., recipes, washing methods, or the like) from the server 3 and various environment information (e.g., weather, temperature, humidity, or the like), and may output the obtained information via a user interface.

The home appliance 10 may operate according to a control command received from the user device 2, the server 3, and/or the other home appliance. For example, the home appliance 10 may operate in accordance with a control command received from the server 3, based on a prior authorization obtained from a user to operate in accordance with the control command of the server 3 even without a user input. Here, the control command received from the server 3 may include a control command input by the user via the user device 2 or a control command based on preset conditions, without being limited thereto.

The user device 2 may transmit information about a user to the home appliance 10 and/or the server 3 through the communication module. For example, the user device 2 may transmit information about a user's location, a user's health status, a user's preference, a user's schedule, or the like, to the server 3. The user device 2 may transmit information about the user to the server 3 based on the user's prior authorization.

The home appliance 10, the user device 2, and/or the server 3 may use artificial intelligence to determine a control command. For example, the server 3 may process information about an operation or a state of the home appliance 10 and information about a user of the user device 2 using techniques, such as artificial intelligence (AI), and may transmit a processing result or a control command to the user device 2 and/or the home appliance 10 based on the processing result.

A dryer 1 described below may be the above-described home appliance 10.

Figure 2:
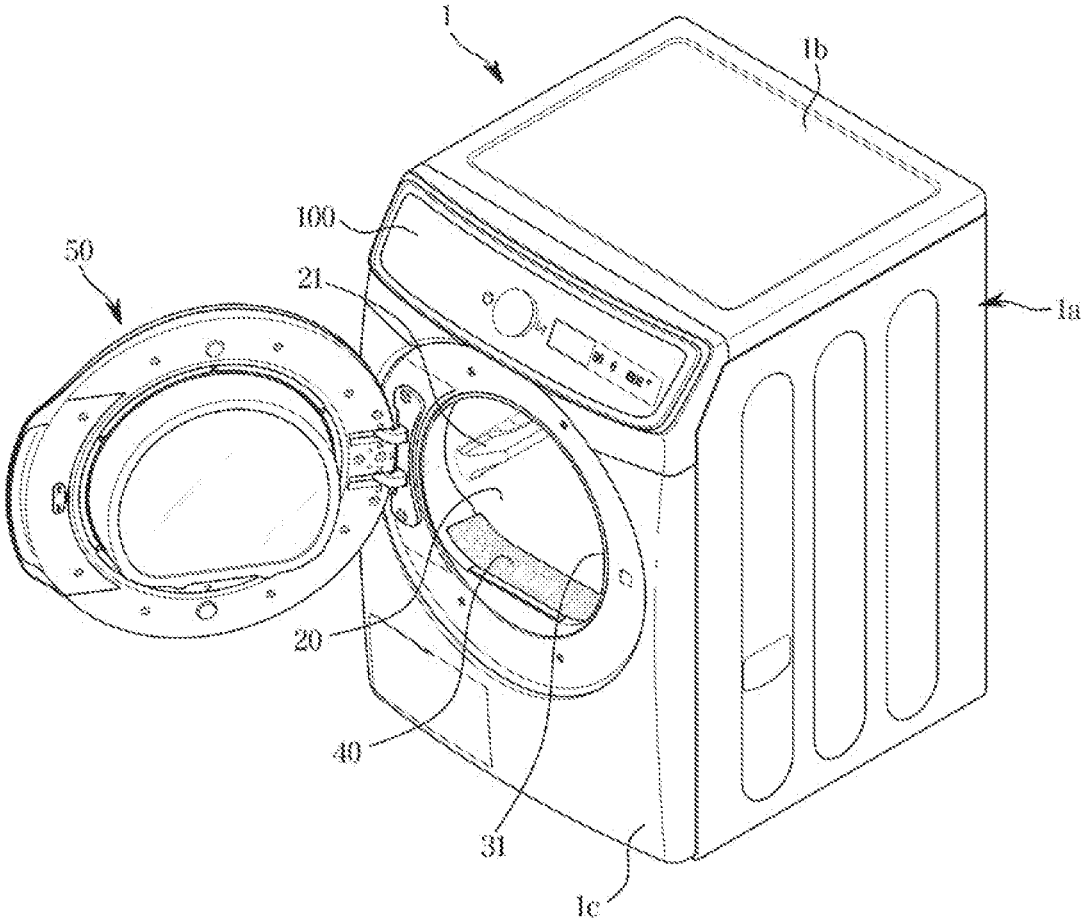
FIG. 2 illustrates a dryer according to an embodiment.

FIG. 2 illustrates a dryer according to an embodiment.

Referring to FIG. 2, the dryer 1 may include a cabinet 1*a* forming an exterior of the dryer 1, and a drum 20 rotatably installed in the cabinet 1*a*. The cabinet 1*a* may have a substantially parallelepiped shape. The cabinet 1*a* may include an upper cover 1*b* forming an upper surface of the dryer 1, a front cover 1*c* forming a front surface of the dryer 1, and a base forming a bottom surface of the dryer 1.

For example, each of the front cover 1*c*, the upper cover 1*b*, and the base that form the cabinet 1*a* may be separately provided and assembled. In another example, some of the elements forming the cabinet 1*a* (e.g., the front cover 1*c*, the upper cover 1*b*, and the base) may be integrally formed.

An inlet opening 31 allowing clothes, which are objects to be dried, to be inserted into or withdrawn from the drum 20 is provided in the front surface of the cabinet 1*a*. The dryer 1 may include a door 50 for opening and closing the inlet opening 31 formed in the front cover 1*c*. A user may open the door 50 and then insert or remove the objects into or from the drum 20 through the inlet opening 31. As the inlet opening 31 is closed and the dryer 1 begins operating, a door lock may lock the door 50.

A user interface 100 for an interaction between a user and the dryer 1 may be disposed at an upper side of the front surface of the cabinet 1*a*. The user interface 100 may obtain a user input and display various information about the dryer 1. A location of the user interface 100 is not limited to the front surface of the cabinet 1*a*. The user interface 100 may be located in various positions of the dryer 1.

The user interface 100 may include a display. Also, the user interface 100 may include an inputter to obtain a user input related to an operation of the dryer 1. The inputter may include a rotatable dial and various buttons. The user interface 100 may include various other forms of inputters and displays.

The display may be provided in various types of display panels. For example, the display may be a liquid crystal display (LCD) panel, a light emitting diode (LED) panel, an organic light emitting diode (OLED) panel, or a micro LED. The display may include a touch screen and be used as an input device.

The display may display information entered by a user or information provided to the user on various screens. The display may display information related to an operation of the dryer 1 as at least one from among an image and text. In addition, the display may display a graphic user interface (GUI) that enables control of the dryer 1. That is, the display may display user interface elements (UI elements) such as icons.

Figure 7:
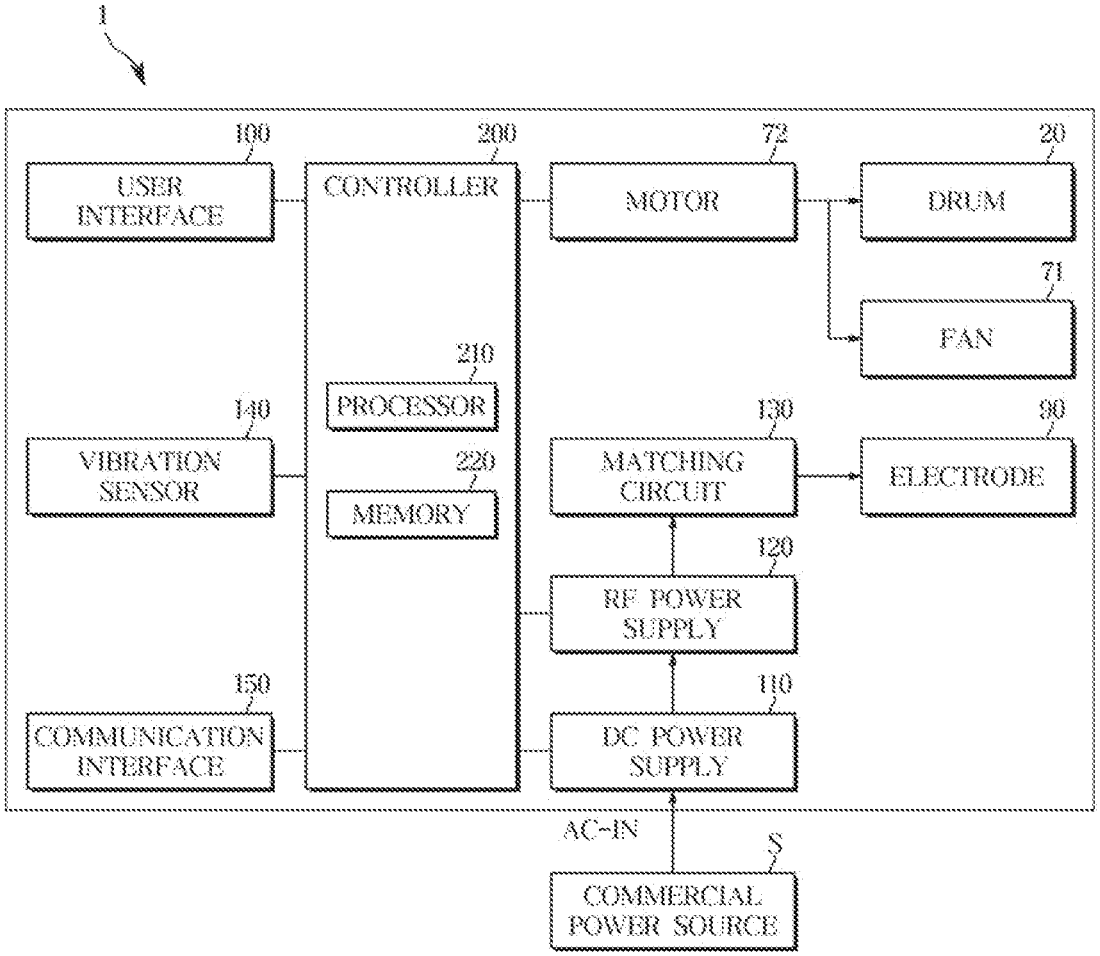
FIG. 7 is a control block diagram of a dryer according to an embodiment.

The inputter may transmit an electrical signal (voltage or current) corresponding to a user input to a controller 200 (see FIG. 7). The inputter may include various buttons and/or dials. For example, the inputter may include at least one from among a power button for turning the dryer 1 on or off, a start/stop button for starting or stopping a drying operation, a drying course button for selecting a drying course, a temperature button for setting a drying temperature, and a time button for setting a drying time. The various buttons may be provided as physical buttons or touch buttons.

The dial included in the inputter may be rotatable. As the dial rotates, the UI elements shown on the display may be sequentially moved. The dryer 1 may perform drying according to a selected drying course. The drying course may include drying parameters such as drying temperature and drying time. Depending on a location of an object to be dried in the drum 20, the type of the object, and/or the amount of the object, different drying courses may be selected.

The dryer 1 may include a filter 40 removably mounted to the front cover 1*c*. The filter 40 may filter out foreign substances, such as lint, that flows with air circulating inside the drum 20.

Figure 3:
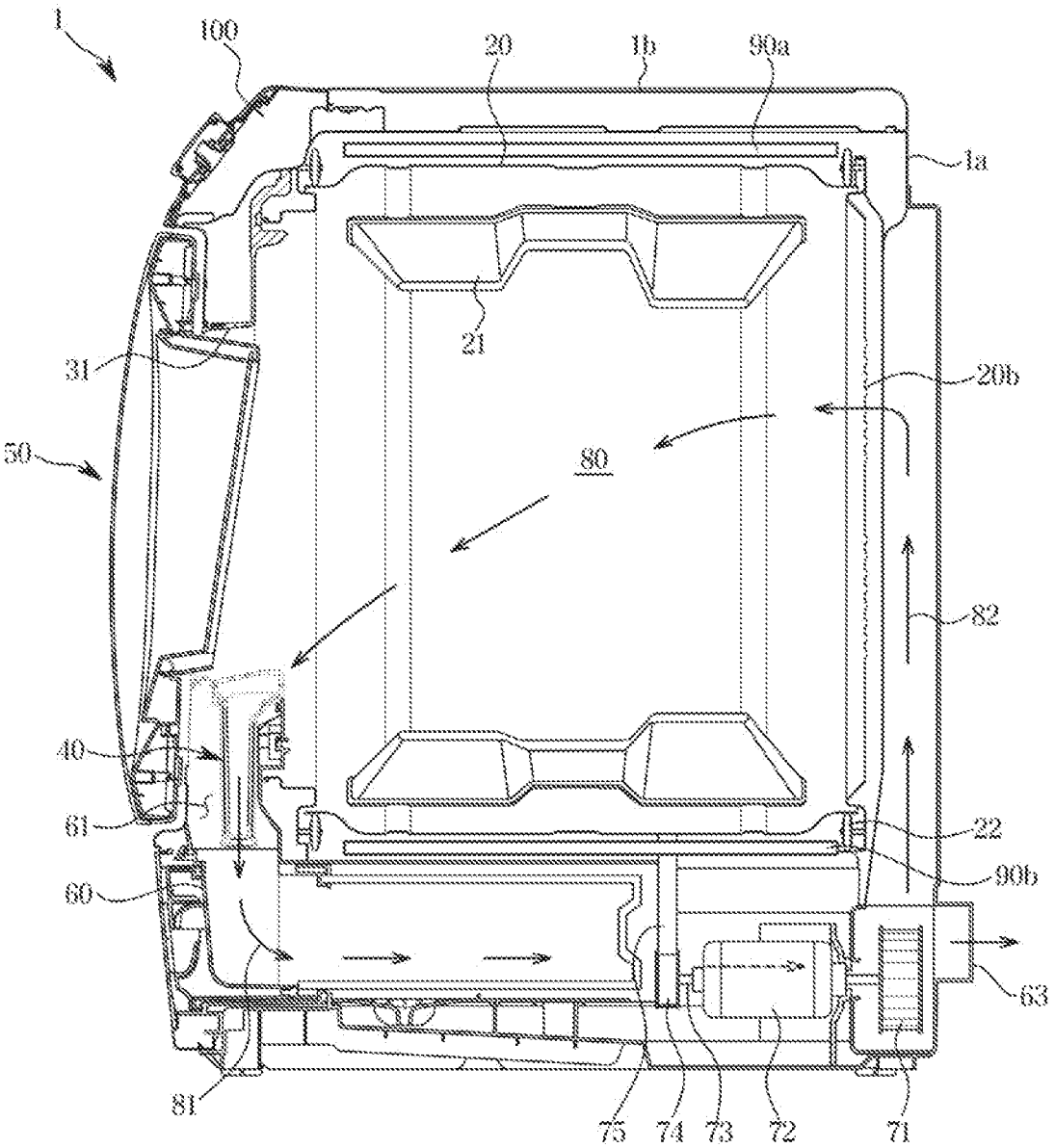
FIG. 3 is a cross-sectional view of a dryer according to an embodiment.

FIG. 3 is a cross-sectional view of a dryer according to an embodiment.

Referring to FIG. 3, the drum 20 having a cylindrical shape may be disposed inside the cabinet 1*a*. The drum 20 may accommodate objects to be dried (hereinafter, also referred to as "drying objects"). The drum 20 may receive power from a motor 72 and may be rotatable. The drum 20 may be disposed inside the cabinet 1*a* and may be rotatable about a rotating axis substantially horizontal to the ground.

A lifter 21 may be provided on an inner circumferential surface of the drum 20 to lift drying objects during rotation of the drum 20. According to a rotation speed of the drum 20, the drying objects may be repeatedly lifted by the lifter 21 and then fall. A roller 22 supporting the drum 20 for smooth rotation of the drum 20 may be provided on an outer circumferential surface of the drum.

A driving device may be disposed at a lower portion of the inside of the cabinet 1*a*. The driving device may be mounted on the base. The driving device may include the motor 72, a pulley 74 transferring power of the motor 72 to the drum 20, and a belt 75.

The pulley 74 may be connected to a rotating shaft 73 connected to the motor 72. As the rotating shaft 73 is rotated by the motor 72, the pulley 74 may rotate together with the rotating shaft 73. The belt 75 may be installed to be wound around an outer surface of the pulley 74 and an outer surface of the drum 20. As the belt 75 rotates due to a driving force of the motor 72, the drum 20 may rotate together with the belt 75. The drum 20 may rotate clockwise or counterclockwise.

A flow path 80 for circulating air may be formed within the cabinet 1*a* and within the drum 20. The flow path 80 may include an air discharge flow path 81 for discharging air from the inside of the drum 20 to the outside of the drum 20, and an air supply flow path 82 for supplying air to the inside of the drum 20.

The dryer 1 may include a discharge duct 60 forming the air discharge flow path 81. The filter 40 may be disposed at an inlet 61 of the discharge duct 60. The discharge duct 60 may penetrate the cabinet 1*a*, and an outlet 63 of the discharge duct 60 may be exposed to the outside of the cabinet 1*a*. Air flowing into the inlet 61 of the discharge duct 60 may be filtered by passing through the filter 40. The filter 40 may filter out foreign substances, such as lint, contained in the air.

Inside the cabinet 1*a*, a fan 71 may be provided to cause air to flow. Air in the drum 20 may be introduced into the discharge duct 60 by rotation of the fan 71. In addition, by rotation of the fan 71, air may be supplied into the drum 20 via the air supply flow path 82 and an air inlet 20*b* of the drum 20. The air supplied into the drum 20 may be used for drying the objects to be dried.

The motor 72 may rotate the fan 71 as well as the drum 20. Although it has been illustrated that the drum 20 and the fan 71 are driven by the single motor 72, embodiments of the present disclosure are not limited thereto. A fan motor to drive the fan 71 may be separately provided. The motor 72 may also be directly connected to the drum 20 to rotate the drum 20. In a case where the motor 72 is directly connected to the drum 20, the pulley 74 and belt 75 may be omitted.

A plurality of electrodes may be arranged between the cabinet 1*a* and the drum 20. In FIG. 3, two electrodes 90 (e.g., a first electrode 90*a* and a second electrode 90*b*) are shown. The electrodes 90 may be spaced apart from each other along a circumference of the drum 20. The electrodes 90 may also be spaced apart from the cabinet 1*a* and the drum 20. By applying a voltage to the electrodes 90, an electric field may be generated in the drum 20. The electric field generated in the drum 20 may cause dielectric (e.g., water molecules) contained in the object to be dried to vibrate. Due to the vibration of the dielectric (e.g., water molecules), dipole friction heat may be generated, which may heat the dielectric. The heated dielectric may evaporate, thereby drying the object. The evaporated dielectric may be discharged out of the drum 20 together with the air supplied into the drum 20. Hereinafter, the electrodes 90 are described in more detail with reference to FIG. 4, FIG. 5 and FIG. 6.

Figure 4:
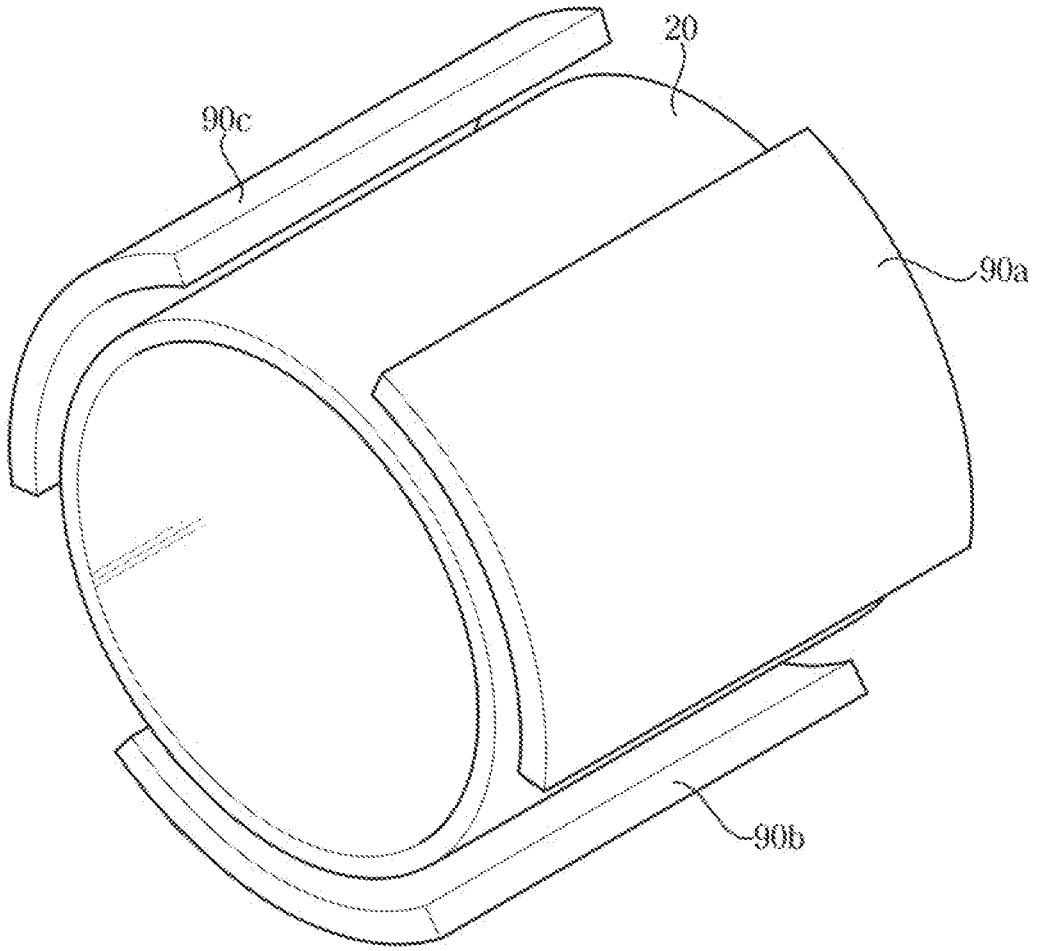
FIG. 4 illustrates an arrangement structure of electrodes according to an embodiments.
Figure 5:
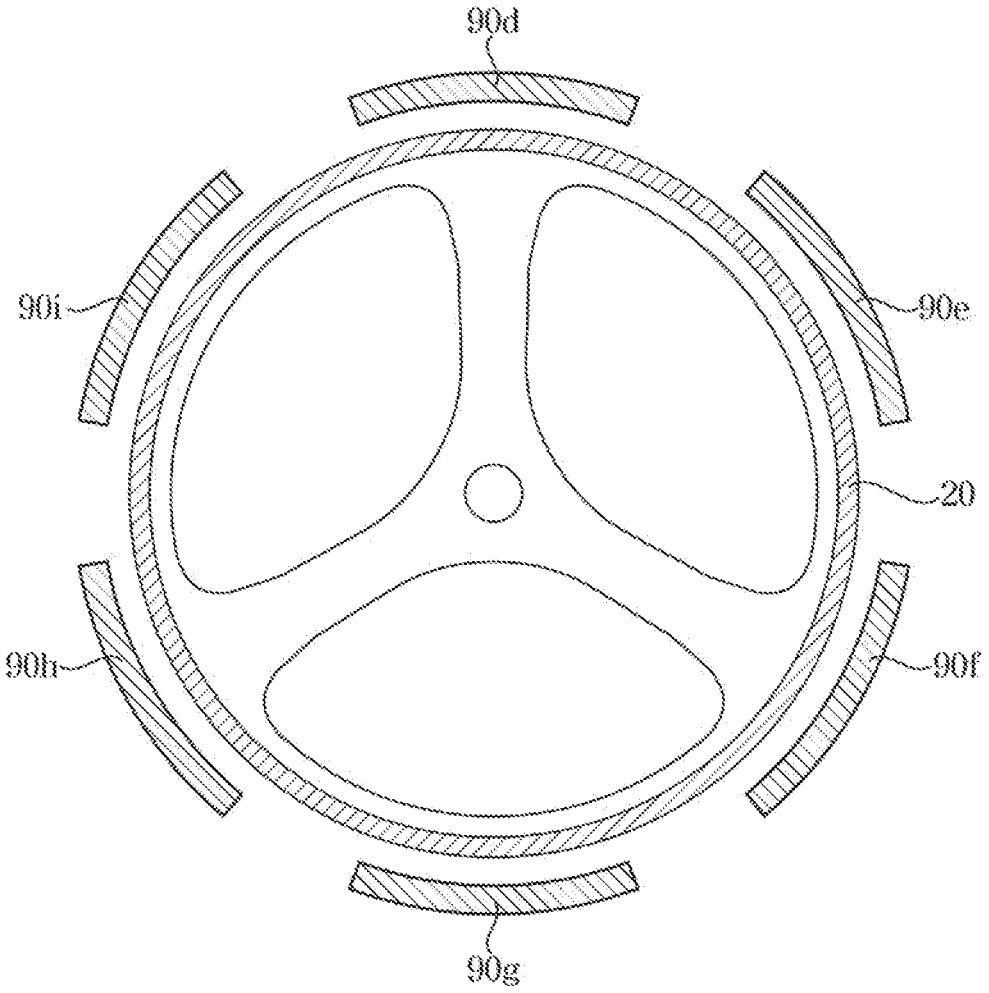
FIG. 5 illustrates an arrangement structure of electrodes according to an embodiments.
Figure 6:
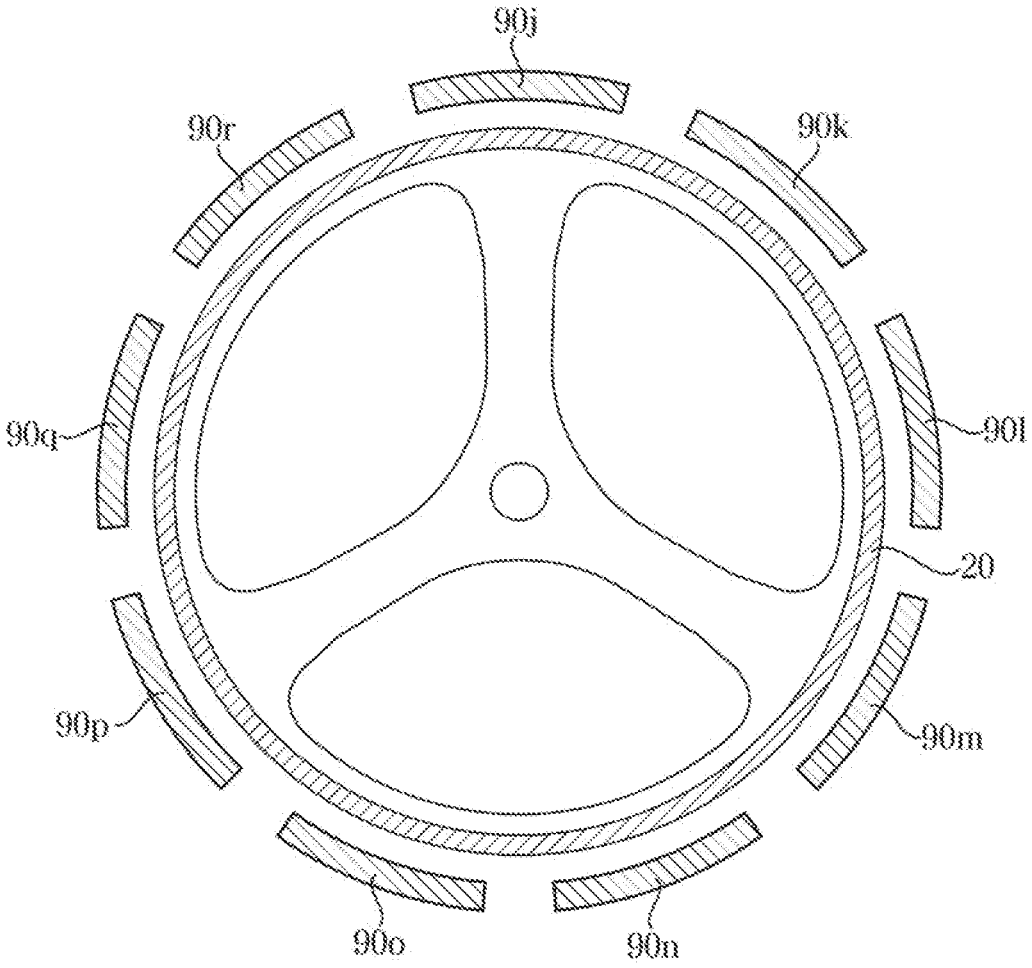
FIG. 6 illustrates an arrangement structure of electrodes according to an embodiments.

FIG. 4, FIG. 5, and FIG. 6 illustrate arrangement structures of electrodes according to various embodiments.

Referring to FIG. 4, FIG. 5, and FIG. 6, a plurality of electrodes 90 may be spaced apart from each other along a circumference of the drum 20. Each of the plurality of electrodes 90 may have a shape of a plate having a curvature. The plurality of electrodes 90 may be provided in various numbers.

For example, as shown in FIG. 4, three electrodes 90 (e.g., a first electrode 90*a*, a second electrode 90*b*, and a third electrode 90*c*) may be spaced apart and adjacent to each other along the circumference of the drum 20. The first electrode 90*a* may be disposed over an upper right side of the drum 20, the second electrode 90*b* may be disposed below the drum 20 to be adjacent to the first electrode 90*a*, and the third electrode 90*c* may be disposed over an upper left side of the drum 20 to be adjacent to the first electrode 90*a*.

As shown in FIG. 5, six electrodes 90 (e.g., a fourth electrode 90*d*, a fifth electrode 90*e*, a sixth electrode 90*f*, a seventh electrode 90*g*, an eighth electrode 90*h*, and a ninth electrode 90*i*) may be spaced apart and adjacent to each other along the circumference of the drum 20. The fourth electrode 90*d* and the seventh electrode 90*g* may be disposed above and below the drum 20, respectively. The fifth electrode 90*e* and the sixth electrode 90*f* may be disposed over the right side of the drum 20. The eighth electrode 90*h* and the ninth electrode 90*i* may be disposed over the left side of the drum 20.

As shown in FIG. 6, nine electrodes (e.g., a tenth electrode 90*j*, an eleventh electrode 90*k*, a twelfth electrode 90*l*, a thirteenth electrode 90*m*, a fourteenth electrode 90*n*, a fifteenth electrode 900, a sixteenth electrode 90*p*, a seventeenth electrode 90*q*, and an eighteenth electrode 90*r*) may be spaced apart from each other along the circumference of the drum 20.

The number of electrodes is not limited to those illustrated. More than nine electrodes may be provided.

The plurality of electrodes 90 may be fixed between the cabinet 1*a* and the drum 20. Because the drum 20 is not connected to the plurality of electrodes 90, the plurality of electrodes 90 do not restrict the rotation of the drum 20. In addition, because the plurality of electrodes 90 are arranged along the circumference of the drum 20, electric fields may be generated in various areas in the drum 20. Accordingly, while the drum 20 is rotating, the dryer 1 according to embodiments of the present disclosure may generate electric fields in the drum 20 via the plurality of electrodes 90 and may perform drying of the object to be dried.

In contrast, in an existing technology, a drum and electrodes are electrically connected to each other by placing the electrodes in the drum or by using wiring, and thus rotation of the drum is limited to avoid disconnection between the drum and the electrodes. In addition, in an existing technology, an electric field is generated only in a fixed area in the drum, and thus drying by dielectric heating may not occur in a case where an object to be dried moves out of the electric field.

The dryer 1 according to embodiments of the present disclosure may change a location of an electric field concentration area for dielectric heating by monitoring a distribution of objects to be dried in the drum 20. In addition, the dryer 1 may generate at least one electric field concentration area, and may adjust a size of the at least one electric field concentration area in consideration of the amount of the objects, a movement of the objects, and an eccentricity of the objects. Thus, a drying efficiency by dielectric heating may be improved. An operation of the dryer 1 is described in detail below.

FIG. 7 is a control block diagram of a dryer 1 according to an embodiment.

Referring to FIG. 7, the dryer 1 may include the motor 72 rotating the drum 20 and the fan 71, a radio frequency (RF) power supply 120 applying a voltage to the electrodes 90 disposed around the drum 20, and the controller 200 controlling the RF power supply 120 to generate an electric field for dielectric heating of drying objects accommodated in the drum 20 through the electrodes 90. The dryer 1 may also include the user interface 100, a direct current (DC) power supply 110, a matching circuit 130, a vibration sensor 140, and a communication interface 150.

The controller 200 may be electrically coupled to components of the dryer 1, and may control the components of the dryer 1. For example, the controller 200 may control the motor 72 to rotate the drum 20 and the fan 71. The controller 200 may control the DC power supply 110, the RF power supply 120, and the matching circuit 130 to apply multiphase voltages to the plurality of electrodes 90.

The user interface 100 may obtain a user input and may display various information about an operation of the dryer 1. The user interface 100 may include an inputter for obtaining a user input and a display for displaying information. The user interface 100 may also include a speaker for outputting sound.

The user interface 100 may display operational information of the dryer 1. For example, the user interface 100 may display a drying course, a drying temperature, an estimated drying time, and/or a time remaining to the end of drying. The drying course may include predetermined drying settings (e.g., degree of dryness, additional time for wrinkle prevention, drying time) based on a type of an object to be dried (e.g., shirt, bedding, underwear) and material of an object to be dried (e.g., cotton, wool). For example, a standard drying may include drying settings that may be applied to most drying objects, and a bedding drying may include drying settings that are optimized for drying a blanket.

The DC power supply 110 may convert alternating current (AC) power supplied from a commercial power source S into DC power and transmit to the RF power supply 120. The RF power supply 120 may generate an RF signal, and may apply the RF signal to the electrodes 90. The matching circuit 130 may be arranged between the RF power supply 120 and the plurality of electrodes 90. The RF signal generated by the RF power supply 120 may be transmitted to the electrodes 90 via the matching circuit 130. A sinusoidal voltage may be applied to the electrodes 90 by the RF signal.

The controller 200 may control the DC power supply 110 to adjust a magnitude of the voltage applied to the electrodes 90. As the power supplied to the RF power supply 120 increases, an amplitude of the RF signal may increase, and the magnitude of the voltage applied to the electrodes 90 may increase. The magnitude of the voltage may be represented by an effective value. The controller 200 may control the RF power supply 120 to regulate a phase of the voltage applied to the electrodes 90. In addition, the controller 200 may control the DC power supply 110 to supply power to electronic components of the dryer 1.

The matching circuit 130 may match an output impedance of the RF power supply 120 with an electrode impedance of each of the plurality of electrodes 90. The matching circuit 130 may include a variable inductor and a variable capacitor. In a case where a difference between the output impedance of the RF power supply 120 and the electrode impedance of the electrodes 90 exists, reflected power is generated from the electrodes 90, and a power transfer efficiency is reduced. In order to minimize the reflected power, a matching of the output impedance of the RF power supply 120 and the electrode impedance of at least one of the electrodes 90 may be performed. The controller 200 may control the matching circuit 130 to perform the impedance matching.

The electrode impedance may vary depending on many factors, such as the amount of an object to be dried, a type of an object to be dried, a size of an object to be dried, the amount of water contained in an object to be dried, and a distribution of an object to be dried.

For example, in a case where a dielectric (e.g., water) having a high dielectric constant is present between the plurality of electrodes 90, charge accumulates in the dielectric, and thus a strength of an electric field formed between the electrodes 90 may decrease. A decrease in the strength of the electric field may decrease magnitudes of voltages detected at the electrodes 90, and the electrode impedance may be decreased. As the drying of the drying object progresses, the water contained in the drying object is removed, and thus the electrode impedance detected may gradually increase.

The controller 200 may determine the electrode impedance based on a magnitude of voltage detected at an output end of the matching circuit 130. Depending on a location of the drying object in the drum 20, the electrode impedances detected at each of the plurality of electrodes 90 may vary. The controller 200 may use the electrode impedance of each of the plurality of electrodes 90 to obtain distribution information of the drying object. In addition, the controller 200 may determine the amount of water (i.e., moisture content) contained in the drying object based on the detected electrode impedance.

The DC power supply 110, the RF power supply 120, and the matching circuit 130 shown in FIG. 7 may be provided in a single power module. In other words, the DC power supply 110 and the matching circuit 130 may be included in the RF power supply 120. A single power module may be common to the plurality of electrodes 90, and the plurality of electrodes 90 may be connected in parallel to the single power module.

In addition, a plurality of DC power supplies 110, a plurality of RF power supplies 120, and a plurality of the matching circuit 130 corresponding to the plurality of electrodes 90 may be provided. In other words, a plurality of power modules including the DC power supplies 110, the RF power supplies 120, and the plurality of the matching circuit 130 may be provided. Each of the plurality of electrodes 90 may be independently connected to each of the power modules.

The vibration sensor 140 may detect vibrations of the drum 20. The vibration sensor 140 may be provided on at least one from among the drum 20 and the motor 72 connected to the drum 20. The vibration sensor 140 may transmit an electrical signal corresponding to the vibration of the drum 20 to the controller 200.

The controller 200 may obtain the distribution information of the drying object accommodated in the drum 20 based on a vibration pattern of the drum 20. In a case where the drum 20 rotates while the object to be dried is accommodated in the drum 20, the object may clump or disperse. Depending on a distribution state of the object, eccentricity of the drum 20 may occur, and various vibration patterns may be detected. The distribution information of the drying object corresponding to the various vibration patterns of the drum 20 may be stored in advance in a memory 220 and/or the server 3 (see FIG. 1). The controller 200 may obtain the distribution information of the drying object corresponding to the vibration pattern of the drum 20 from the memory 220 and/or the server 3. The distribution information of the drying object may include a location of the drying object in the drum 20 and the amount of the drying object. The amount of the drying object may represent a weight of the object to be dried.

The distribution information of the drying object may be obtained using at least one from among the magnitudes of the voltages detected at the electrodes 90 and the vibration pattern of the drum 20 in a weight detection process. The weight detection process may be performed prior to a drying process for drying the object. However, obtaining the distribution information of the drying object is not limited to only in the weight detection process. The distribution state of the drying object may also be monitored in the drying process.

The communication interface 150 may perform communication with at least one from among the user device 2 and the server 3 over a network. The controller 200 may obtain various information, various signals, and/or various data from the user device 2 and/or the server 3 via the communication interface 150. For example, the communication interface 150 may receive a remote control signal from the user device 2. The controller 200 may obtain firmware and/or software for operation of the dryer 1 from the server 3 via the communication interface 150.

The communication interface 150 may include a variety of communication circuits. The communication interface 150 may include wireless communication circuits and/or wired communication circuits. For example, a communication circuit may be provided to support wireless communication methods such as wireless local area network, home radio frequency (home RF), infrared communication, ultra-wide band (UWB) communication, Wi-Fi, Bluetooth, and Zigbee.

The controller 200 may include a processor 210 and the memory 220. The memory 220 may include a volatile memory (e.g., a static random-access memory (S-RAM), a dynamic random-access memory (D-RAM)) a non-volatile memory (e.g., a read-only memory (ROM), and an erasable programmable read-only memory (EPROM)). The processor 210 and the memory 220 may be implemented as separate chips, or may be implemented as a single chip. Also, a plurality of processors and a plurality of memories may be provided. The processor 210 may process various data and various signals using instructions, data, programs, and/or software stored in the memory 220. The processor 210 may generate a control signal to control the components of the dryer 1. The processor 210 may include a single core or may include a plurality of cores.

The controller 200 may obtain the distribution information of the drying object accommodated in the drum 20 based on the magnitudes of the voltages detected at each of the plurality of electrodes 90. The distribution information of the drying object may include a location of the drying object in the drum 20 and the amount of the drying object.

Based on a difference between a magnitude of a predetermined reference voltage and a magnitude of a voltage detected at each of the plurality of electrodes 90, the controller 200 may determine the location of the drying object in the drum 20 and the amount of the drying object. The amount of the drying object may represent a weight of the object to be dried.

In a case where a drying object including a dielectric (e.g., water) is located between the plurality of electrodes 90, a strength of an electric field changes, and thus a magnitude of a reference voltage corresponding to an RF signal and the magnitudes of the voltages actually detected at each of the plurality of electrodes 90 may differ. For example, in a case where a magnitude of a voltage detected at the first electrode 90*a* is different from the magnitude of the reference voltage, it may be determined that the drying object is located adjacent to the first electrode 90*a*. The controller 200 may determine that the greater the difference between the magnitude of the predetermined reference voltage and the magnitude of the voltage detected at each of the plurality of electrodes 90, the greater the amount of the drying object.

A large amount of the drying object may indicate a large amount of moisture contained in the drying object. As described above, the presence of water, which is a dielectric, between the plurality of electrodes 90 may reduce the strength of the electric field formed between the plurality of electrodes 90, may reduce the magnitudes of the voltages detected at the electrodes 90, and may reduce the electrode impedance. As the drying of the drying object progresses, the water contained in the drying object may be removed. As the drying progresses, the magnitudes of the voltages detected at the electrodes 90 may gradually increase, and the electrode impedance detected may gradually increase. In other words, as the drying progresses, the difference between the magnitude of the voltage detected at each of the electrodes 90 and the magnitude of the reference voltage may gradually decrease. The controller 200 may determine a degree of dryness of the drying object based on a change in magnitude of the voltages detected at the electrodes 90 and/or a change in electrode impedance.

The controller 200 may determine a phase difference of voltages to be applied to each of two adjacent electrodes of the plurality of electrodes 90 based on the distribution information of the drying object. The controller 200 may determine a minimum value of the phase difference of the voltages to be applied to each of the two adjacent electrodes based on the number of the plurality of electrodes 90. The controller 200 may determine the phase difference of the voltages to be applied to each of the two adjacent electrodes as an integer multiple of the minimum value based on the distribution information of the drying object.

In addition, the controller 200 may determine the phase difference of voltages between two adjacent electrodes based on the distribution information of the drying object to allow a plurality of electric field concentration areas to be simultaneously generated in the drum 20. For example, in a case where six electrodes 90 (see FIG. 5) or nine electrodes 90 (see FIG. 6) exist, a plurality of electric field concentration areas may be generated simultaneously based on a phase difference of voltages between two adjacent electrodes.

The controller 200 may control the RF power supply 120 to apply multi-phase voltages to the plurality of electrodes 90 based on the phase difference of voltages to be applied to each of the two adjacent electrodes in order to dry the drying object while the drum 20 is rotating. That is, the voltages applied to the two adjacent electrodes may have different phases.

The controller 200 may control the DC power supply 110 to adjust a peak value of the voltages applied to the plurality of electrodes 90 based on the distribution information of the drying object. For example, the controller 200 may control the DC power supply 110 to increase a peak value of a voltage applied to at least one of the plurality of electrodes 90 based on the location of the drying object and the amount of drying object.

The controller 200 may determine a rotation speed of the drum 20 based on the distribution information of the drying object. For example, in a case where a plurality of relatively lightweight drying objects are identified as being distributed at different locations in the drum 20, the controller 200 may determine a rotation speed of the drum 20 to be relatively high in order to prevent the plurality of drying objects from clumping and to increase dielectric heating efficiency. In a case where the drum 20 rotates at a relatively high speed, centrifugal force causes the drying objects to adhere to an inner surface of the drum 20, and thus dielectric heating of the plurality of drying objects may occur simultaneously at different locations in the drum 20 while the drum 20 is rotating.

In another example, in a case where a relatively heavy drying object is identified as being located in one area in the drum 20, the controller 200 may determine a rotation speed of the drum 20 to be relatively low. In a case where the relatively heavy drying object is present, rotating the drum 20 at a high speed may increase an eccentricity of the drum 20 and cause excessive vibration. By rotating the drum 20 at a low speed, the relatively heavy drying object may remain in a lower portion of the drum 20 for a relatively long time. In this case, a dielectric heating efficiency may be improved by increasing a strength of an electric field generated in the lower portion of the drum 20.

The controller 200 may adjust the phase difference of the voltages to be applied to each of the two adjacent electrodes based on a change in the distribution information of the drying object as the drying of the drying object is performed.

For example, in a case where a drying object falls during the rotation of the drum 20, the controller 200 may determine a phase difference of voltages to be applied to each of two adjacent electrodes to be a minimum value. In a case where the distribution of the drying object is concentrated on an outer edge of an inner space of the drum 20 (i.e., an inner wall of the drum 20) as the drying is performed, the controller 200 may increase the phase difference of the voltages to be applied to each of the two adjacent electrodes to an integer multiple of the minimum value.

In an early drying process, the drying object may fall in the drum 20 because the drying object contains a relatively large amount of water. As the drying progresses, water is removed from the drying object, and thus a weight of the drying object decreases. Accordingly, the drying object may adhere to the inner wall of the drum 20 and rotate with the drum 20. In other words, the distribution of the drying object may change, as the drying of the drying object is performed.

The controller 200 may determine a phase difference of voltages to be applied to each of two electrodes of the plurality of electrodes 90 to be a minimum value, to allow an electric field to affect a center of the inner space of the drum 20 in the early drying process. As described above, the minimum value of the phase difference may be determined based on the number of the plurality of electrodes 90. In order for the electric field to be concentrated on the outer edge of the inner space of the drum 20 (i.e., the inner surface of the drum 20) as the drying progresses, the controller 200 may increase the phase difference of the voltages to be applied to each of the two electrodes of the plurality of electrodes 90 to an integer multiple of the minimum value.

The configuration of the dryer 1 is not limited to the configuration illustrated in FIG. 7. Another component may be added in addition to the components shown in FIG. 7, or one or more of the components illustrated in FIG. 7 may be omitted. For example, the dryer 1 may further include a humidity sensor for detecting humidity in the drum 20 and a weight sensor for detecting a weight of object to be dried.

Figure 8:
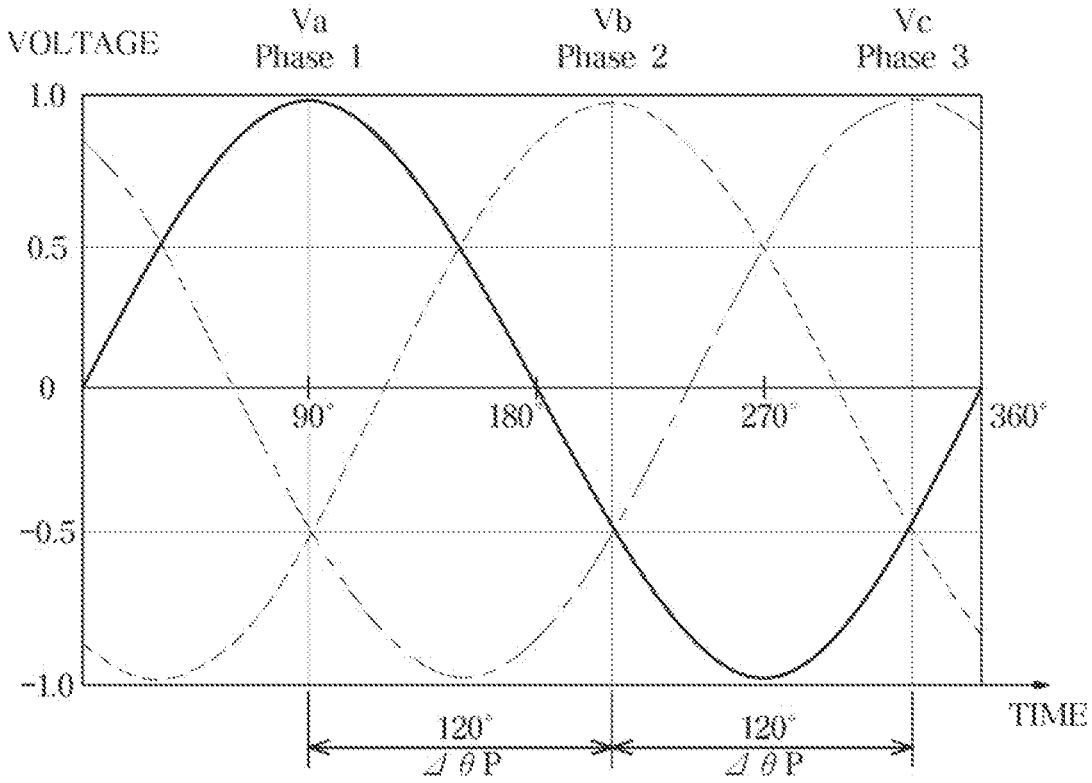
FIG. 8 is a graph illustrating an example of multi-phase voltages.

FIG. 8 is a graph illustrating an example of multi-phase voltages.

Referring to the graph of FIG. 8, multiple-phase voltages may be applied to the plurality of electrodes 90. For example, three-phase voltage may be applied to the plurality of electrodes 90. Three electrodes 90 (see FIG. 4) may be present, and a phase difference $\Delta\theta p$ of voltages applied to each of two adjacent electrodes may be determined to be 120 degrees. In this case, a first voltage Va applied to the first electrode 90*a*, a second voltage Vb applied to the second electrode 90*b*, and a third voltage Vc applied to the third electrode 90*c* may appear as sinusoidal waves with the phase difference of 120 degrees from each other.

Because the first voltage Va, the second voltage Vb, and the third voltage Vc change over time, a magnitude and phase of two voltages applied to two electrodes may become equal at a given time. In a case where the magnitude and phase of the two voltages applied to the two electrodes become equal, a potential difference is eliminated, and a strength of an electric field generated between the electrodes at a given time may decrease. A strength of an electric field generated between the first electrode 90*a* and the second electrode 90*b*, a strength of an electric field generated between the second electrode 90*b* and the third electrode 90*c*, and a strength of an electric field generated between the third electrode 90*c* and the first electrode 90*a* may repeatedly increase and decrease.

Likewise, even in a case where six electrodes 90 (see FIG. 5) or nine electrodes 90 (see FIG. 6) are present, a strength of an electric field generated between two electrodes may repeatedly increase and decrease. As a result, a location of an electric field concentration area in the drum 20 may change periodically, i.e., a rotating electric field may be generated.

The phase difference $\Delta\theta p$ of the voltages applied to each of the two adjacent electrodes is not limited to the phase difference $\Delta\theta p$ illustrated in FIG. 8. The phase difference $\Delta\theta p$ may be determined differently depending on the number of electrodes, distribution information of drying object, and/or how many phases the power input to the dryer 1 has.

Figure 9:
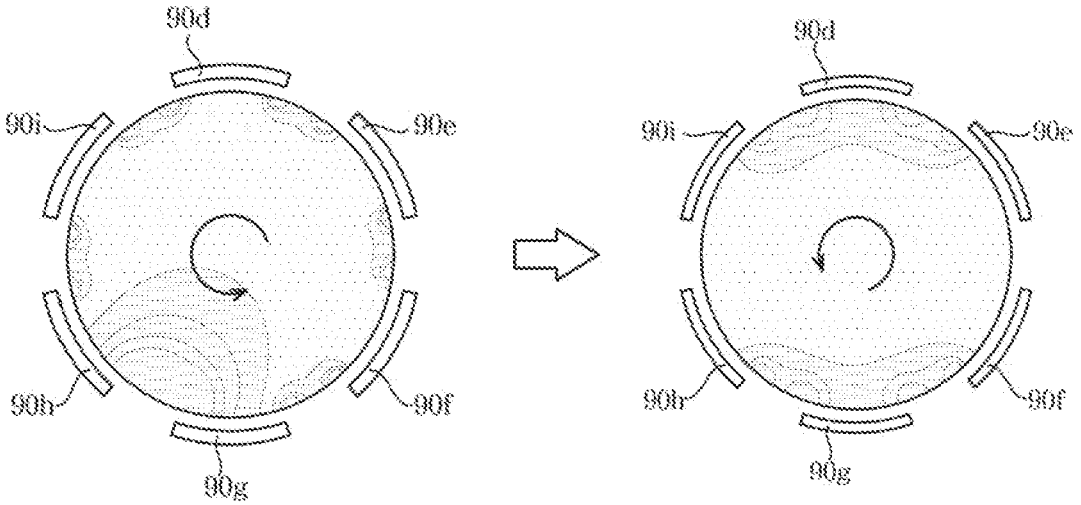
FIG. 9 illustrates a change in an electric field formed in a drum as a phase difference of voltages applied to each of two adjacent electrodes is changed.

FIG. 9 illustrates a change in an electric field formed in a drum as a phase difference of voltages applied to each of two adjacent electrodes is changed.

Referring to FIG. 9, the dryer 1 may change a phase difference of voltages applied to each of two adjacent electrodes of the plurality of electrodes 90. As the phase difference of the voltages applied to each of the two adjacent electrodes is changed, an electric field concentration area formed in an inner space of the drum 20 may change. In this regard, as an example, six electrodes 90 (e.g., a fourth electrode 90*d*, a fifth electrode 90*e*, a sixth electrode 90*f*, a seventh electrode 90*g*, an eighth electrode 90*h*, and a ninth electrode 90*i*) are provided along a circumference of the drum 20.

As the phase difference of the voltages applied to each of the two adjacent electrodes is changed, the electric field concentration area may be formed to affect a center of the inner space of the drum 20 (see the left portion of FIG. 9), or to be concentrated on an outer edge of the inner space of the drum 20 (see the right portion of FIG. 9). In a case where the phase difference of the voltages applied to each of the two adjacent electrodes is set to be small (e.g., the phase difference is set to a minimum value), a relatively large electric field concentration area may be generated, as shown in the left portion of FIG. 9. In a case where the phase difference of the voltages applied to each of the two adjacent electrodes is set to be large (e.g., the phase difference is set to be greater than the minimum value, as an integer multiple of the minimum value), a relatively small electric field concentration area may be generated on the outer edge of the inner space of the drum 20, as shown in the right portion of FIG. 9. That is, an electric field may become concentrated on the outer edge of the inner space of the drum 20, as the phase difference is set to be larger.

As a drying process progresses, the phase difference of the voltages applied to each of the two adjacent electrodes may be adjusted such that the electric field concentration area affects the center of the inner space in the drum 20 and then is concentrated on the outer edge of the inner space of the drum 20. Conversely, the phase difference of the voltages applied to each of the two adjacent electrodes may be adjusted such that the electric field concentration area is concentrated on the outer edge of the inner space of the drum 20 and then affects the center of the inner space in the drum 20. The adjustment of the phase difference to change the electric field concentration area may be caused by a distribution of drying object accommodated in the drum 20, a weight of the drying object, and/or a dryness of the drying object.

Hereinafter, various embodiments of generation and change of electric field concentration areas are described.

Figure 10:
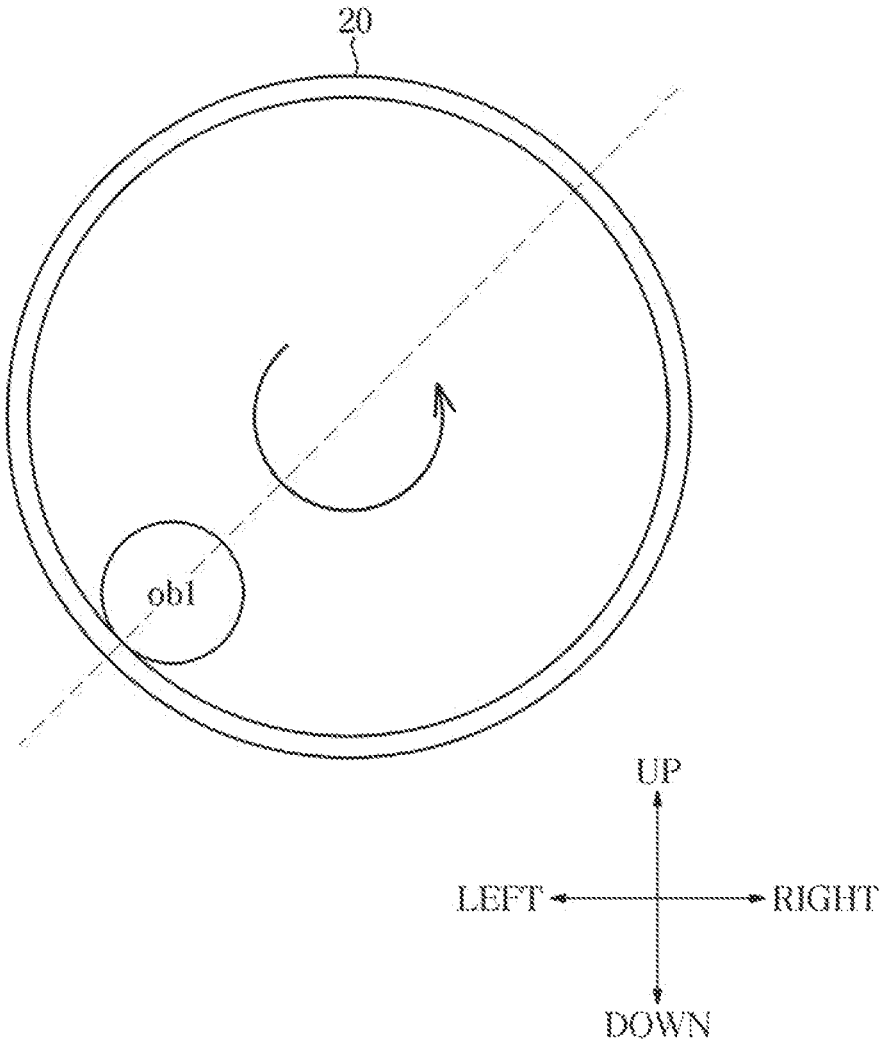
FIG. 10 illustrates an example in which a drying object is distributed in one area of a drum.
Figure 11:
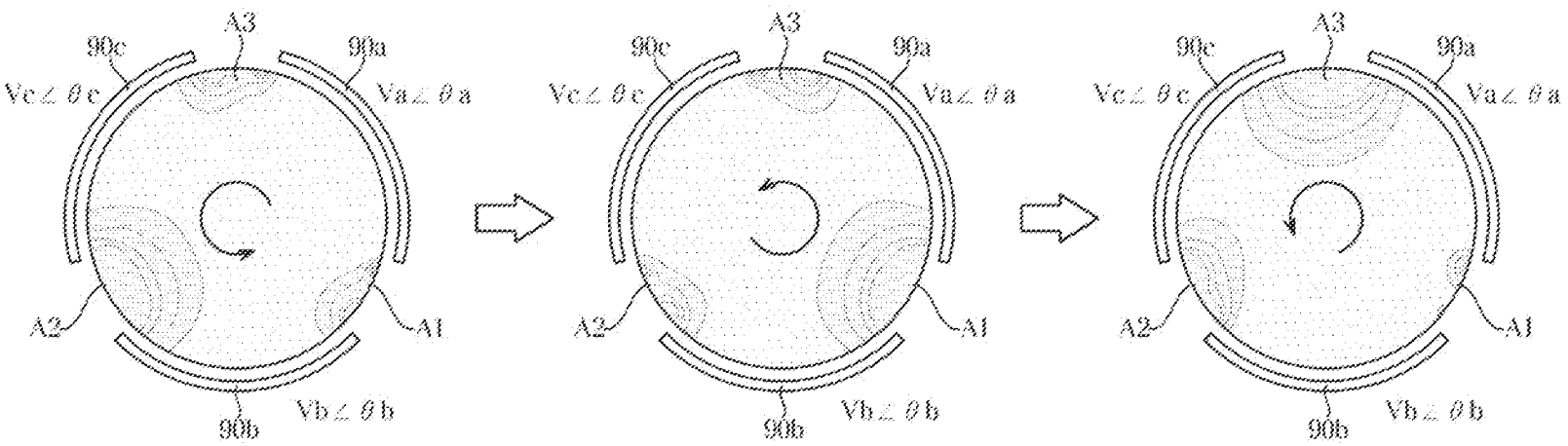
FIG. 11 illustrates an example of changing an electric field concentration area in response to the distribution state of the drying object of FIG. 10 in a case where three electrodes are present.
Figure 12:
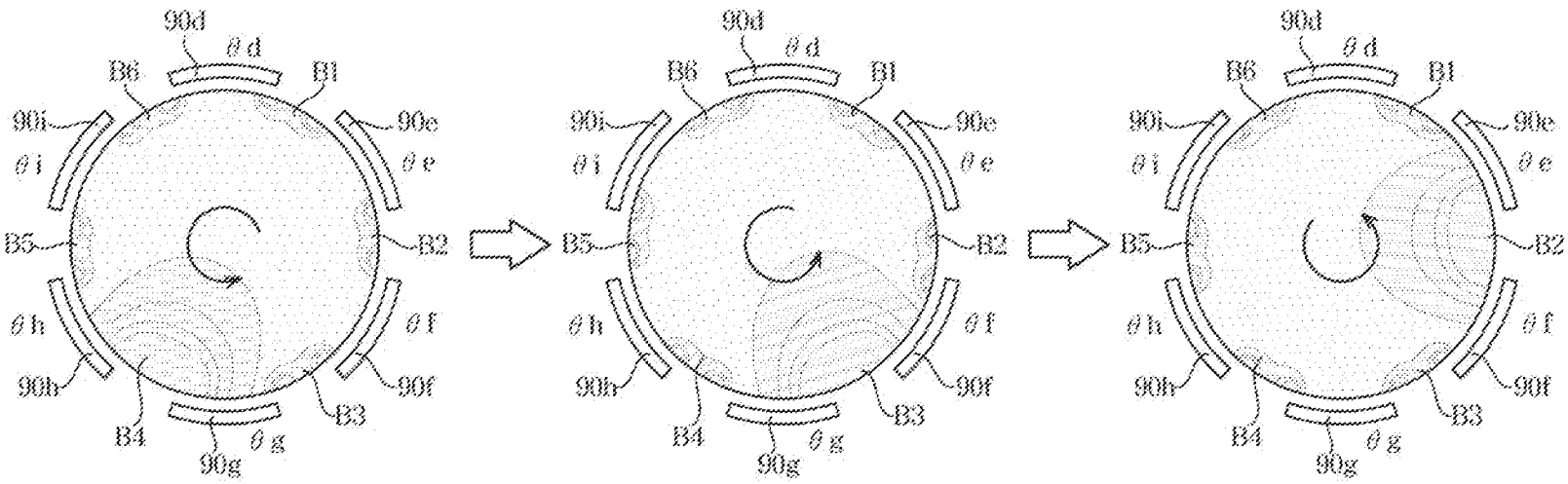
FIG. 12 illustrates an example of changing an electric field concentration area in response to the distribution state of the drying object of FIG. 10 in a case where six electrodes are present.

FIG. 10 illustrates an example in which a drying object is distributed in one area of a drum. FIG. 11 illustrates an example of changing an electric field concentration area in response to the distribution state of the drying object of FIG. 10 in a case where three electrodes are present. FIG. 12 illustrates an example of changing an electric field concentration area in response to the distribution state of the drying object of FIG. 10 in a case where six electrodes are present.

Referring to FIG. 10, the controller 200 of the dryer 1 may rotate the drum 20 clockwise or counterclockwise at a predetermined reference rotation speed, and may apply a reference voltage to the electrodes 90 in order to obtain distribution information of an object to be dried (e.g., a drying object ob1). The controller 200 may obtain a vibration pattern of the drum 20 based on a signal transmitted from the vibration sensor 140. In addition, the controller 200 may control the DC power supply 110 and the RF power supply 120 to generate an RF signal corresponding to a predetermined reference voltage.

Based on at least one from among the vibration pattern of the drum 20 and magnitudes of voltages actually detected at the electrodes 90, the controller 200 may identify that the drying object ob1 is located at one area in the drum 20, and may determine a weight of the drying object ob1.

To dry the drying object ob1, the dryer 1 may rotate the drum 20 counterclockwise or clockwise, and may generate an electric field in the drum 20. Along with the rotation of the drum 20, the drying object ob1 may rotate. In FIG. 11 and FIG. 12, a counterclockwise direction of rotation of the drum 20 is shown as an example.

Referring to FIG. 11, it is shown, as an example, that three electrodes 90 (e.g., a first electrode 90*a*, a second electrode 90*b*, and a third electrode 90*c*) are provided along a circumference of the drum 20. To generate an electric field for drying the drying object ob1 in the drum 20, the controller 200 may control the RF power supply 120 to apply multi-phase voltages to the first electrode 90*a*, the second electrode 90*b*, and the third electrode 90*c*. A first voltage Va∠θa may be applied to the first electrode 90*a*, a second voltage Vb∠θb may be applied to the second electrode 90*b*, and a third voltage Vc∠θc may be applied to the third electrode 90*c*.

By applying the multi-phase voltages to the first electrode 90*a*, the second electrode 90*b*, and the third electrode 90*c*, locations of electric field concentration areas may change periodically. The electric field concentration areas may be generated in a first area A1 between the first electrode 90*a* and the second electrode 90*b*, a second area A2 between the second electrode 90*b* and the third electrode 90*c*, and a third area between the third electrode 90*c* and the first electrode 90*a*.

To apply the multi-phase voltages to the first electrode 90*a*, the second electrode 90*b*, and the third electrode 90*c*, the controller 200 may determine a phase difference Δθp of voltages to be applied to each of two adjacent electrodes. The controller 200 may determine a minimum value of the phase difference Δθp of the voltages to be applied to each of the two adjacent electrodes based on the number of electrodes 90. In addition, the controller 200 may determine the phase difference Δθp of the voltages to be applied to each of the two adjacent electrodes, to be an integer multiple of the minimum value, based on distribution information of the drying object.

In a case where three electrodes 90 are provided, the minimum value of the phase difference Δθp of the voltages to be applied to each of two adjacent electrodes may be determined to be 120 degrees, which is obtained by dividing 360 degrees by three. The phase difference Δθp between the first voltage Va∠θa and the second voltage Vb∠θb, the phase difference Δθp between the second voltage Vb∠θb and the third voltage Vc∠θc, and the phase difference Δθp between the third voltage Vc∠θc and the first voltage Va∠θa may all be determined to be 120 degrees.

The rotation of the drum 20 in a counterclockwise direction may cause the drying object ob1 to move counterclockwise from a lower left side of the drum 20, and a location of an electric field concentration area may change in an order of the second area A2, the first area A1, and the third area A3. The first area A1 may be adjacent to the first electrode 90*a* and the second electrode 90*b*, the second area A2 may be adjacent to the second electrode 90*b* and the third electrode 90*c*, and the third area A3 may be adjacent to the third electrode 90*c* and the first electrode 90*a*. That is, the location of the electric field concentration area may move in a counterclockwise direction. As such, the dryer 1 according to an embodiment of the present disclosure may change the locations of the electric field concentration areas in response to the rotation of the drum 20 and the movement of the drying object ob1, thereby improving a drying efficiency by dielectric heating.

Referring to FIG. 12, it is shown, as an example, that six electrodes 90 (e.g., a fourth electrode 90*d*, a fifth electrode 90*e*, a sixth electrode 90*f*, a seventh electrode 90*g*, an eighth electrode 90*h*, and a ninth electrode 90*i*) are provided along the circumference of the drum 20. To generate an electric field for drying the drying object ob1 in the drum 20, the controller 200 may control the RF power supply 120 to apply multi-phase voltages to the fourth electrode 90*d*, the fifth electrode 90*e*, the sixth electrode 90*f*, the seventh electrode 90*g*, the eighth electrode 90*h*, and the ninth electrode 90*i*.

In FIG. 12, it is exemplified that peak values of voltages applied to each of the six electrodes 90 (e.g., the fourth electrode 90*d*, the fifth electrode 90*e*, the sixth electrode 90*f*, the seventh electrode 90*g*, the eighth electrode 90*h*, and the ninth electrode 90*i*) are the same. A phase θd of the voltage applied to the fourth electrode 90*d*, a phase De of the voltage applied to the fifth electrode 90*e*, a phase θf of the voltage applied to the sixth electrode 90*f*, a phase θg of the voltage applied to the seventh electrode 90*g*, a phase θh of the voltage applied to the eighth electrode 90*h*, and a phase θi of the voltage applied to the ninth electrode 90*i* may be the same or different from each other.

To apply multi-phase voltages to the six electrodes, the controller 200 may determine a minimum value of phase difference Δθp of the voltages to be applied to each of two adjacent electrodes based on the number of electrodes 90. In addition, the controller 200 may determine the phase difference Δθp of the voltages to be applied to each of the two adjacent electrodes to be an integer multiple of the minimum value, based on distribution information of the drying object. In a case where the six electrodes are provided, the minimum value of the phase difference Δθp of the voltages to be applied to each of the two adjacent electrodes may be determined to be 60 degrees, which is obtained by dividing 360 degrees by 6.

The controller 200 may determine the phase difference Δθp of the voltages to be applied to each of two adjacent electrodes of the six electrodes to be a minimum value (i.e., 60 degrees) based on the drying object ob1 being located at one area in the drum 20. In a case where the phase difference of voltages to be applied to each of the two adjacent electrodes is 60 degrees, a relatively large electric field concentration area may be generated in the drum 20. In this case, the electric field concentration area may affect the center of the inner space of the drum 20.

In FIG. 12, the location of the electric field concentration area may change in an order of a fourth area B4, a third area B3, a second area B2, a first area B1, a sixth area B6, and a fifth area B5. The first area B1 may be adjacent to the fourth electrode 90*d* and the fifth electrode 90*e*, the second area B2 may be adjacent to the fifth electrode 90*e* and the sixth electrode 90*f*, the third area B3 may be adjacent to the sixth electrode 90*f* and the seventh electrode 90*g*, the fourth area B4 may be adjacent to the seventh electrode 90*g* and the eighth electrode 90*h*, the fifth area B5 may be adjacent to the eighth electrode 90*h* and the ninth electrode 90*i*, and the sixth area B6 may be adjacent to the ninth electrode 90*i* and the fourth electrode 90*d*.

Figure 13:
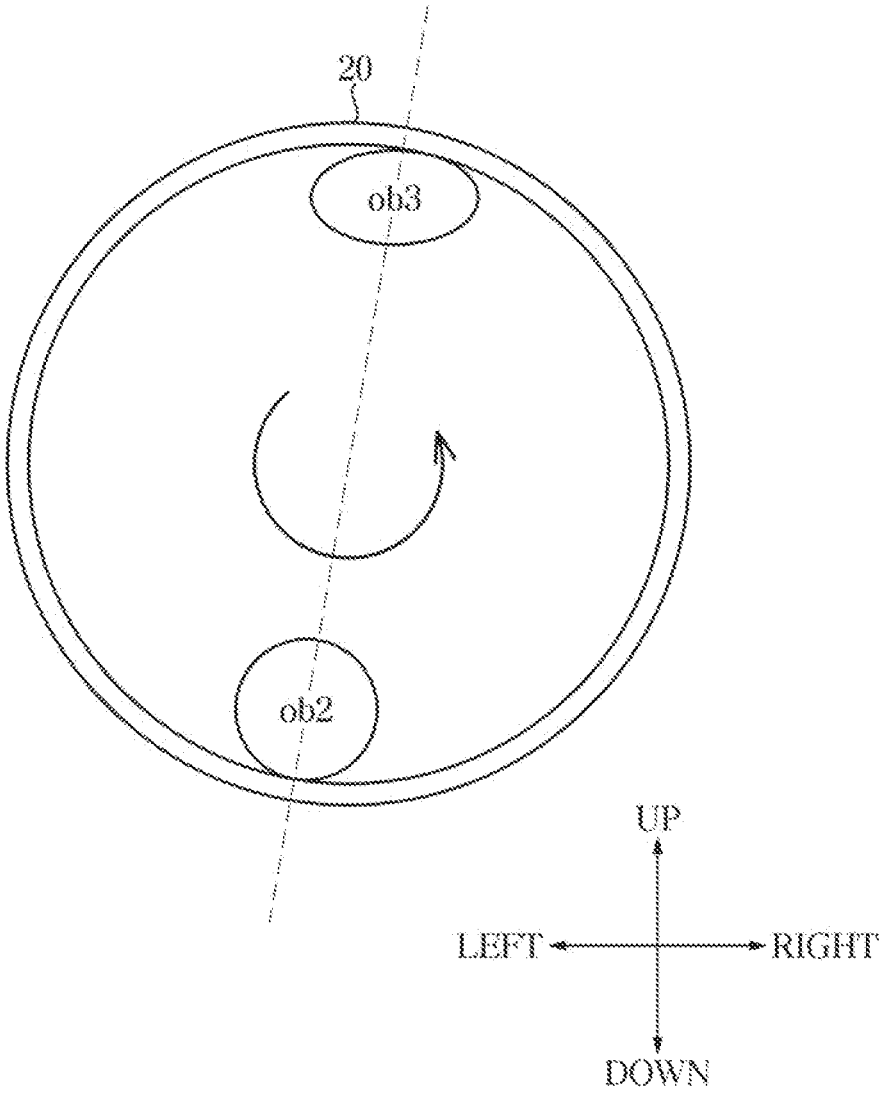
FIG. 13 illustrates an example in which drying objects are distributed in two areas of a drum.
Figure 14:
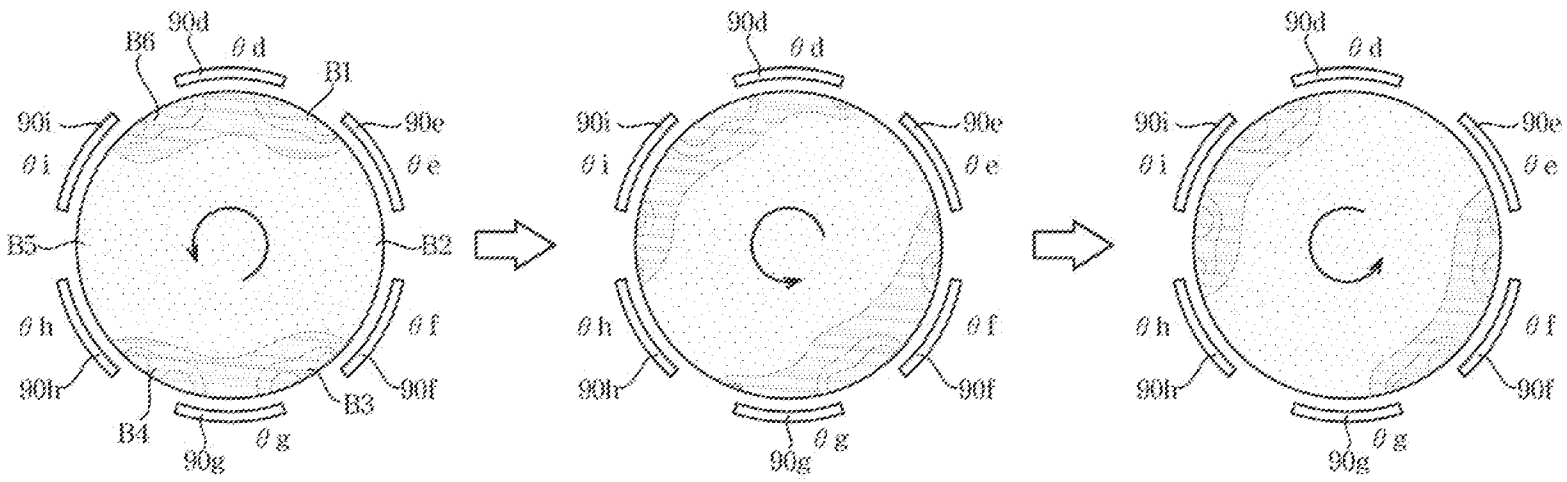
FIG. 14 illustrate an example of changing an electric field concentration area in response to the distribution state of the drying objects of FIG. 13.
Figure 15:
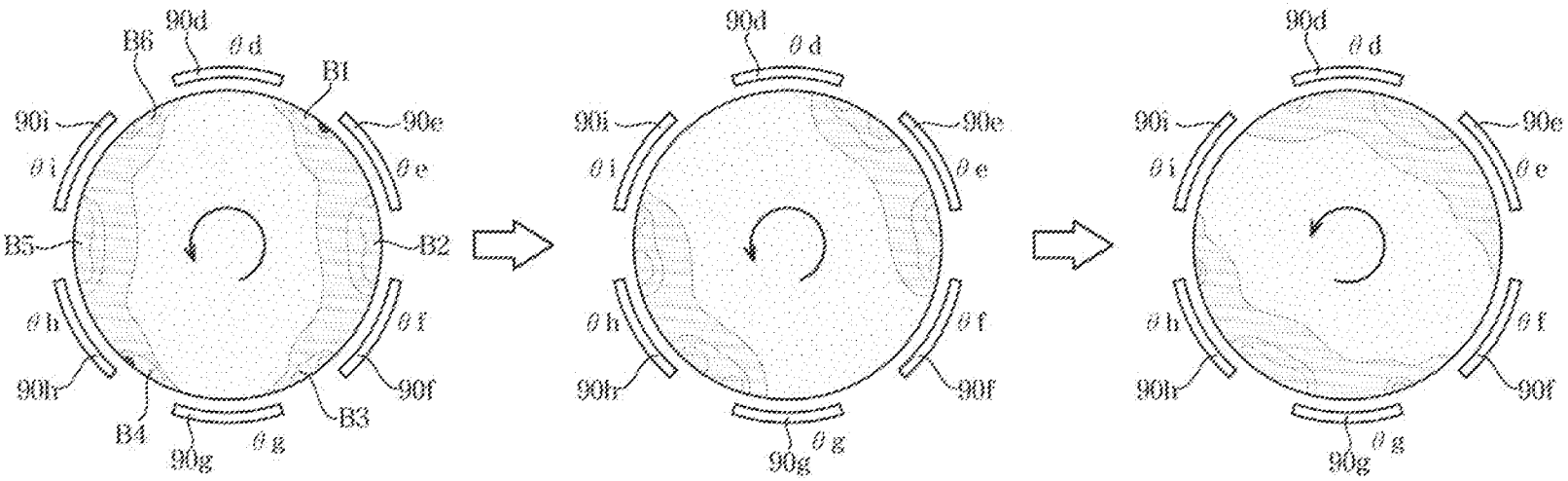
FIG. 15 illustrate an example of changing an electric field concentration area in response to the distribution state of the drying objects of FIG. 13.

FIG. 13 illustrates an example in which drying objects are distributed in two areas of a drum. FIG. 14 and FIG. 15 illustrate examples of changing an electric field concentration area in response to the distribution state of the drying objects described in FIG. 13.

Referring to FIG. 13, the controller 200 of the dryer 1 may identify that a plurality of drying objects (e.g., a first drying object ob2 and a second drying object ob3) are distributed in a plurality of areas in the drum 20, based on at least one from among a vibration pattern of the drum 20 and magnitudes of voltages detected at the electrodes 90. For example, during rotation of the drum 20, the first drying object ob1 and the second drying object ob2 may be distributed along a line passing through a diameter of the drum 20.

In an early drying process, the drying object ob1 may be located in one area in the drum 20, as shown in FIG. 10. The drying object ob1 located in the single area in the drum 20 may be a plurality of drying objects clumped together. Because the drying objects contain a relatively large amount of water in the early drying process, the drying objects may fall in the drum 20 during the rotation of the drum 20. In this case, to improve a dielectric heating efficiency, a size of an electric field concentration area generated between two adjacent electrodes may be relatively increased, as described with reference to FIG. 12.

As the drying is performed, a distribution of the drying objects may change. That is, as the drying progresses, the plurality of drying objects (e.g., the first drying object ob2 and the second drying object ob3) may be distributed in a plurality of areas in the drum 20 (see FIG. 13). In addition, as the drying progresses, water may be removed from the drying objects, and the plurality of drying objects (e.g., the first drying object ob2 and the second drying object ob3) may be adhered to an inner wall of the drum 20 and rotate. In other words, as the drying is performed, the distribution of the drying objects may become concentrated on the inner wall of the drum 20.

The controller 200 of the dryer 1 may adjust a phase difference of voltages to be applied to each of two adjacent electrodes based on changes in distribution information of the drying objects, as the drying of the drying objects is performed. The controller 200 may increase the phase difference of the voltages to be applied to each of the two electrodes of the plurality of electrodes 90 to allow an electric field to be concentrated on an outer edge of an inner space of the drum 20 (i.e., an inner surface of the drum 20), as the drying progresses.

In order to dry the plurality of drying objects (e.g., the first drying object ob2 and the second drying object ob3), the dryer 1 may rotate the drum 20 in a counterclockwise or clockwise direction and simultaneously generate a plurality of electric field concentration areas in the drum 20. In FIG. 14 and FIG. 15, a counterclockwise direction of rotation of the drum 20 is shown as an example.

In FIG. 14 and FIG. 15, it is exemplified that peak values of voltages applied to each of the six electrodes 90 (e.g., the fourth electrode 90*d*, the fifth electrode 90*e*, the sixth electrode 90*f*, the seventh electrode 90*g*, the eighth electrode 90*h*, and the ninth electrode 90*i*) are the same. A phase difference $\Delta\theta p$ of the voltages to be applied to each of two adjacent electrodes may be determined to be 120 degrees, which is an integer multiple of a minimum value. In FIG. 14 and FIG. 15, phases of voltages applied to each of the plurality of electrodes 90 may be as follows. A phase $\theta d$ of a voltage applied to the fourth electrode 90*d* and a phase $\theta g$ of a voltage applied to the seventh electrode 90*g* may be 120. A phase $\theta e$ of a voltage applied to the fifth electrode 90*e* and a phase $\theta h$ of a voltage applied to the eighth electrode 90*h* may be 240. A phase $\theta f$ of a voltage applied to the sixth electrode 90*f* and a phase $\theta i$ of a voltage applied to the ninth electrode 90*i* may be 0. That is, the phase difference $\Delta\theta p$ of the voltages applied to each of the two adjacent electrodes may be determined to be 120 degrees. In this case, a plurality of electric field concentration areas corresponding to the plurality of areas in which the plurality of drying objects (e.g., the first drying objection ob2 and the third drying object ob3) are distributed may be generated.

The rotation of the drum 20 in a counterclockwise direction may cause the plurality of drying objects (e.g., the first drying objection ob2 and the third drying object ob3) to move in a counterclockwise direction while adhering to the inner surface of the drum 20. In response to the movement of the drying objects (e.g., the first drying objection ob2 and the third drying object ob3), location of the plurality of electric field concentration areas may also change. For example, the plurality of electric field concentration areas may be generated simultaneously on opposite sides of the drum 20 with respect to a diameter of the drum 20. The plurality of electric field concentration areas may be generated simultaneously in an upper portion of the drum 20 (e.g., first area B1 and sixth area B6) and a lower portion of the drum 20 (e.g., third area B3 and fourth area B4). Afterwards, electric field concentration areas may also be generated in a fifth area B5 and a second area B2. That is, electric fields may be concentrated sequentially in the sixth area B6, the fifth area B5, the fourth area B4, the third area B3, the second area B2, and the first area B1.

The first area B1 may be adjacent to the fourth electrode 90*d* and the fifth electrode 90*e*, the second area B2 may be adjacent to the fifth electrode 90*e* and the sixth electrode 90*f*, the third area B3 area may be adjacent to the sixth electrode 90*f* and the seventh electrode 90*g*, the fourth area B4 may be adjacent to the seventh electrode 90*g* and the eighth electrode 90*h*, the fifth area B5 area may be adjacent to the eighth electrode 90*h* and the ninth electrode 90*i*, and the sixth area B6 may be adjacent to the ninth electrode 90*i* and the fourth electrode 90*d*.

In a case where the phase difference of voltages to be applied to each of two adjacent electrodes is 120 degrees, a relatively small electric field concentration area may be generated on the outer edge of the inner space of the drum 20 (i.e., the inner surface of the drum 20). Compared to FIG. 12, in FIG. 14, the controller 200 may increase the phase difference of voltages to be applied to each of two adjacent electrodes to allow an electric field to be concentrated on the outer edge of the inner space of the drum 20 (i.e., the inner surface of the drum 20). As the phase difference of the voltages applied to each of the two adjacent electrodes increases, an electric field may become concentrated on the outer edge of the inner space of the drum 20 (i.e., the inner surface of the drum 20).

In a case where nine electrodes are provided as shown in FIG. 6, a minimum value of the phase difference of the voltages applied to each of two adjacent electrodes may be determined to be 40 degrees which is obtained by dividing 360 degrees by 9. The phase difference of the voltages applied to each of the two adjacent electrodes may be determined to be an integer multiple (e.g., 120 degrees) of the minimum value (e.g., 40 degrees) depending on the distribution of the drying objects.

Figure 16:
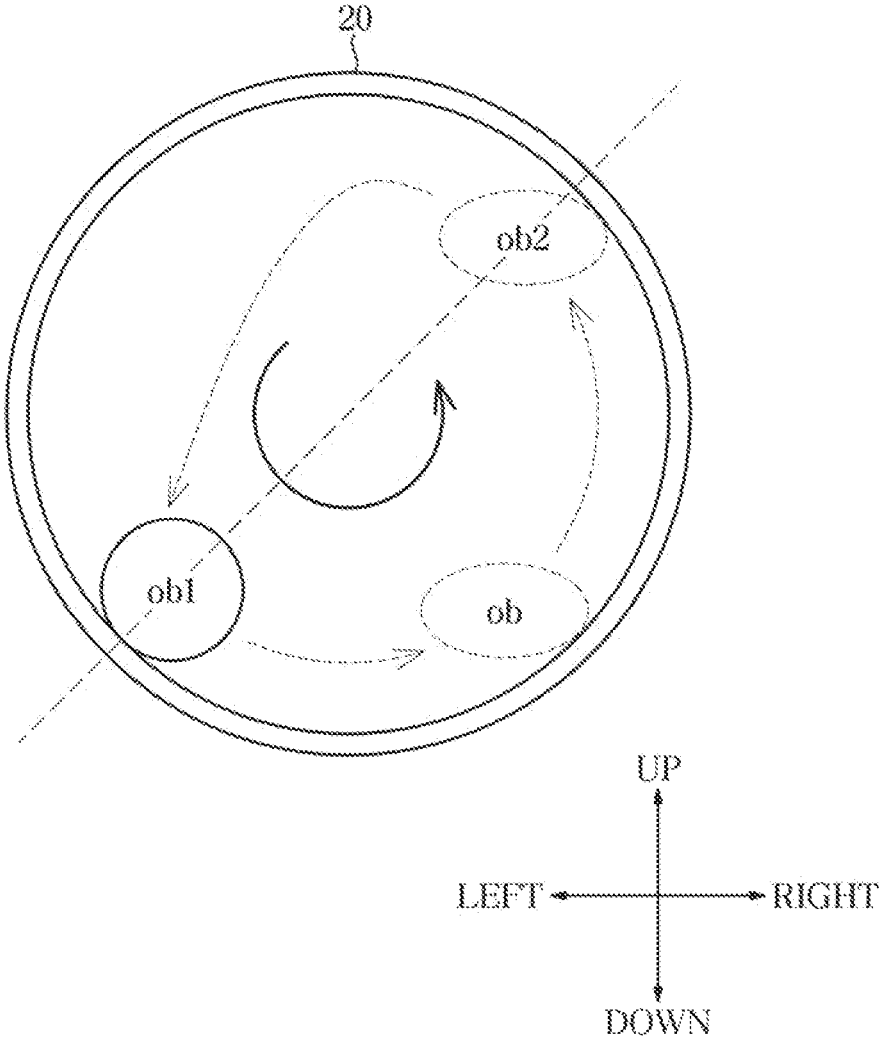
FIG. 16 illustrates an example of a distribution and movement of drying objects in a drum.
Figure 17:
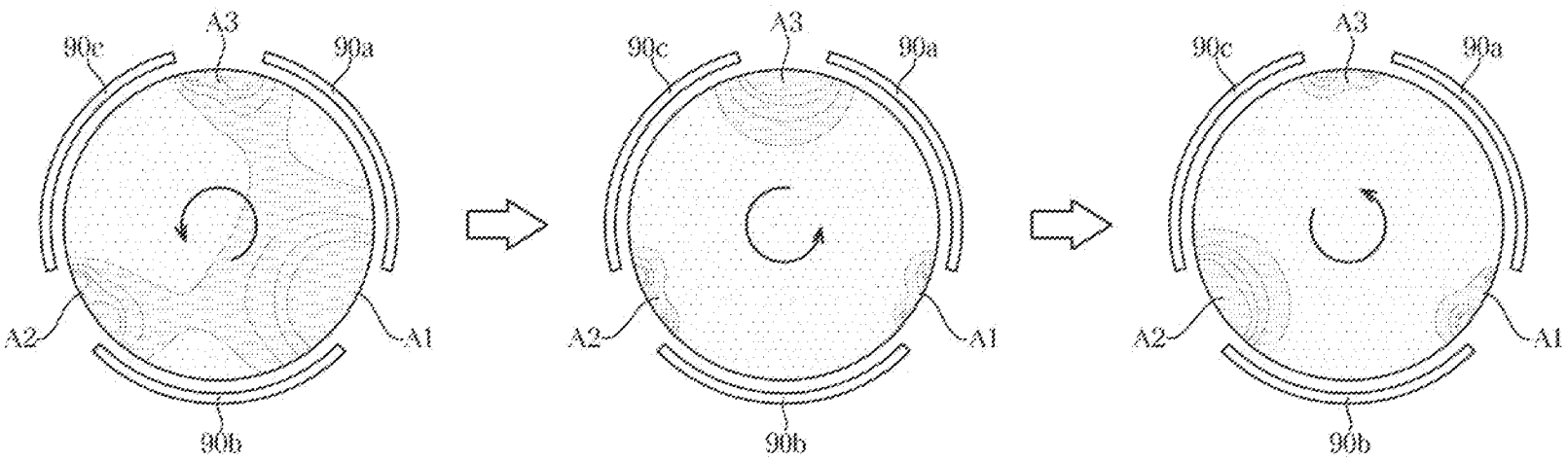
FIG. 17 illustrates an example of changing an electric field concentration area in response to the distribution state of the drying objects of FIG. 16.
Figure 18:
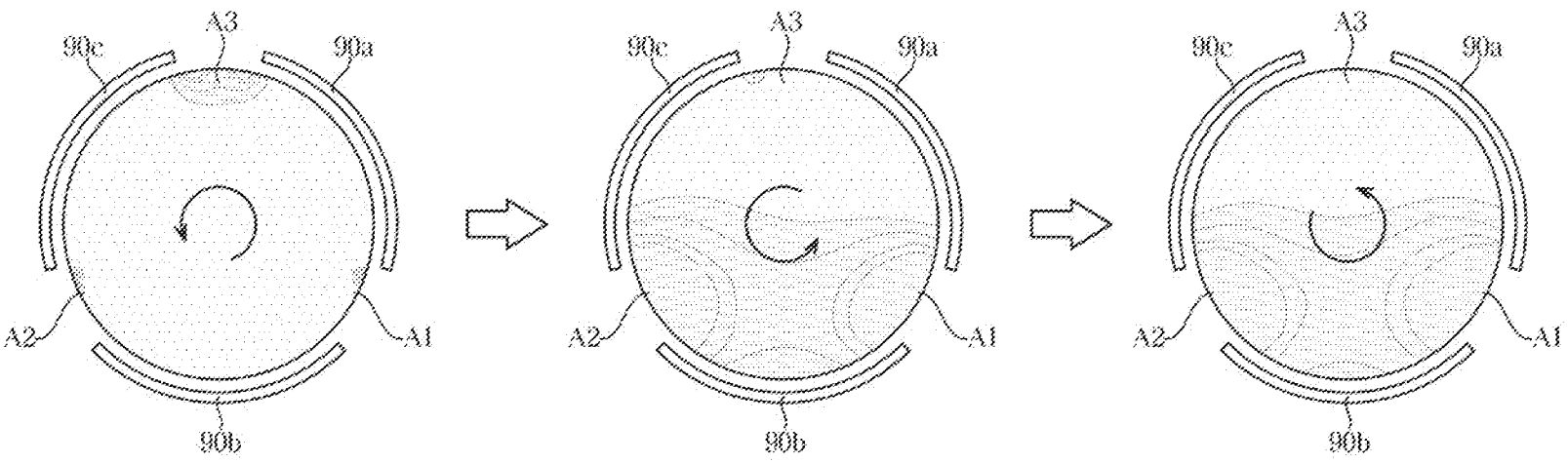
FIG. 18 illustrates an example of changing an electric field concentration area in response to the distribution state of the drying objects of FIG. 16.

FIG. 16 illustrates an example of a distribution and movement of drying objects in a drum. FIG. 17 and FIG. 18 illustrate various examples of changing an electric field concentration area in response to the distribution state of the drying objects described in FIG. 16.

Referring to FIG. 16, a drying object ob may move in the drum 20 as the drum 20 rotates. In a case where the drum 20 rotates at a relatively low speed, the drying object ob may fall before reaching the highest position in the drum 20. For example, in a case where the drum 20 rotates counterclockwise at a relatively low speed, the drying object ob may be spaced apart from an inner surface of the drum 20 at an upper right side of the drum 20. By inertia, the drying object ob may fall into a lower left side of the drum 20. As such, in a case where the drying object ob falls, the drying object Ob may remain at a lower area in the drum 20 for a relatively long period of time.

The controller 200 of the dryer 1 may increase a strength of an electric field generated in the lower area of the drum 20, thereby improving a dielectric heating efficiency. To this end, the controller 200 may control the DC power supply 110 to increase a peak value of voltage of at least one from among the plurality of electrodes 90 based on a location of the drying object and the amount of drying object. The controller 200 may adjust a strength of electric field with respect to at least a portion of the inner space of the drum 20.

In FIG. 17, is it shown, as an example, that three electrodes are disposed around the drum 20 and a strength of electric field generated in a lower right area of the inner space of the drum 20 is increased. The controller 200 may increase a peak value of a first voltage Va applied to the first electrode 90*a* and a peak value of a second voltage Vb applied to the second electrode 90*b*. In addition, the controller 200 may decrease a peak value of a third voltage Vc applied to the third electrode 90*c*.

As the peak value of the first voltage Va and the peak value of the second voltage Vb increase, the strength of the electric field may increase in the lower right area (First area A1) of the drum 20, i.e., a size of an electric field concentration area in the First area A1 may increase. The strength of the electric field may decrease in an upper area (Second area A2) and a lower left area (Third area A3) of the drum 20. However, the electric field generated in the First area A1 may also affect the lower left and upper right areas of the drum 20. Accordingly, even in a case where the drying object Ob is moved from the lower left area to the upper right area of the drum 20 by rotation of the drum 20, drying of the drying object may be effectively performed.

In FIG. 18, it is exemplified that the strength of the electric fields generated in the lower left and lower right areas of the drum 20 is increased. The controller 200 may increase the peak value of the second voltage Vb applied to the second electrode 90*b*. In addition, the controller 200 may decrease the peak value of the first voltage Va applied to the first electrode 90*a* and the peak value of the third voltage Vc applied to the third electrode 90*c*.

As the peak value of the second voltage Vb increases, the strength of the electric field may increase in the lower right area (first area A1) and the lower left area (second area A2) of the inner space of the drum 20. That is, the size of the electric field concentration areas may increase in the first area A1 and the second area A2. The strength of the electric field may decrease in the upper area (third area A3). As a result, a dielectric heating efficiency may increase in the lower area of the drum 20.

As such, the dryer 1 may adjust the location and size of the electric field concentration area by actively responding to the movement of the drying object ob during the rotation of the drum 20. Thus, the drying efficiency of the drying object ob using dielectric heating may be improved.

Figure 19:
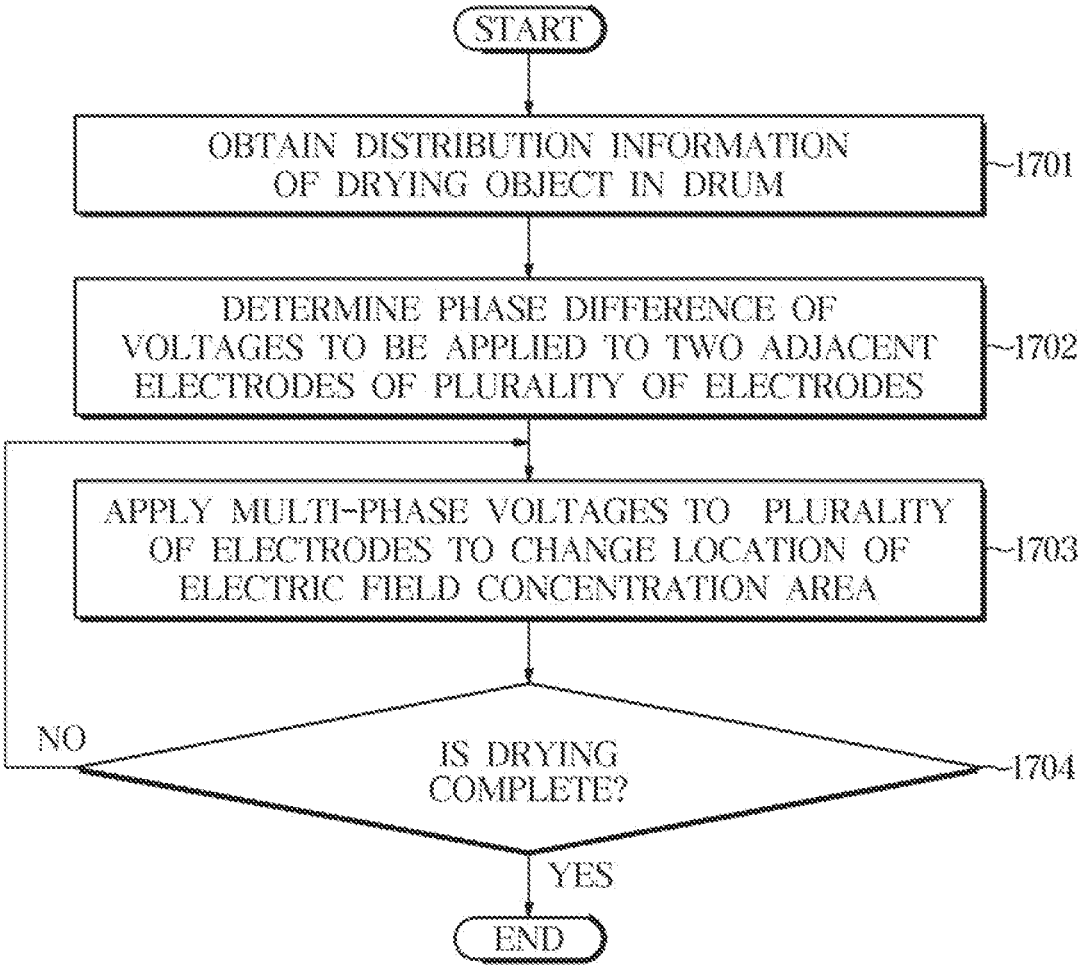
FIG. 19 is a flowchart illustrating a method for controlling a dryer according to an embodiment.

FIG. 19 is a flowchart illustrating a method for controlling a dryer according to an embodiment.

Referring to FIG. 19, the controller 200 of the dryer 1 may obtain distribution information of a drying object in the drum 20 (operation 1701). The controller 200 may obtain the distribution information of the drying object using at least one from among a vibration pattern of the drum 20 and magnitudes of voltages detected at the electrodes 90.

The controller 200 may determine an electrode impedance of each of the plurality of electrodes 90 based on the magnitudes of the voltages detected at the electrodes 90. The controller 200 may use the electrode impedance of each of the plurality of electrodes 90 to obtain the distribution information of the drying object. Based on a difference between a magnitude of a predetermined reference voltage and a magnitude of voltage detected at each of the plurality of electrodes 90, the controller 200 may determine a location of the drying object in the drum 20 and the amount of the drying object. The amount of the drying object may represent a weight of the drying object. The controller 200 may determine that the greater the difference between the magnitude of the predetermined reference voltage and the magnitude of the voltage detected at each of the plurality of electrodes 90, the greater the amount of the drying object. A large amount of the drying object may indicate a large amount of moisture contained in the drying object.

Depending on a distribution state of the drying object, eccentricity of the drum 20 may occur, and various vibration patterns may be detected. The controller 200 may obtain the distribution information of the drying object corresponding to the vibration pattern of the drum 20 from the memory 220 and/or the server 3.

The distribution information of the drying object may include the location of the drying object in the drum 20 and the amount of the drying object. The amount of the drying object may represent a weight of the drying object.

The controller 200 may determine a phase difference of voltages to be applied to each of two adjacent electrodes from among the plurality of electrodes 90 based on the distribution information of the drying object (operation 1702). The controller 200 may apply multi-phase voltages to the plurality of electrodes 90 to change a location of an electric field concentration area in response to rotation of the drum 20 (operation 1703).

The voltages applied to the two adjacent electrodes may have different phases, i.e., the voltages applied to each of the plurality of electrodes 90 may appear as sinusoidal waves with different phases. Because the voltages applied to each of the plurality of electrodes 90 change over time, a strength of an electric field generated between the plurality of electrodes 90 may repeatedly increase and decrease. The location of the electric field concentration area may change dynamically according to a movement of the drying object by the rotation of the drum 20.

The controller 200 may determine whether the drying is complete (operation 1704). The controller 200 may apply multi-phase voltages to the plurality of electrodes 90 until the drying is complete. Once the drying is complete, the controller 200 may control the RF power supply 120 to not apply voltage to the plurality of electrodes 90.

For example, the controller 200 may use the electrode impedance of each of the plurality of electrodes 90 to determine the amount of water (i.e., moisture content) contained in the drying object. In a case where a dielectric (e.g., water) having a high dielectric constant is present between the plurality of electrodes 90, charge accumulates in the dielectric, and thus a strength of an electric field formed between the electrodes 90 may decrease. A decrease in the strength of the electric field may decrease the magnitudes of the voltages detected at the electrodes 90, and the electrode impedance may be decreased. Accordingly, the electrode impedance may be a small value in a state where the drying object contains a large amount of water. As the drying of the drying object progresses, the water contained in the drying object is removed, and thus the electrode impedance may gradually increase. The controller 200 may determine that the drying is complete in response to the electrode impedance being greater than or equal to a predetermined threshold value.

As such, the dryer 1 according to embodiments of the present disclosure may improve a drying efficiency by dielectric heating, by changing the location of the electric field concentration area in response to the rotation of the drum 20 and the movement of the drying object.

Figure 20:
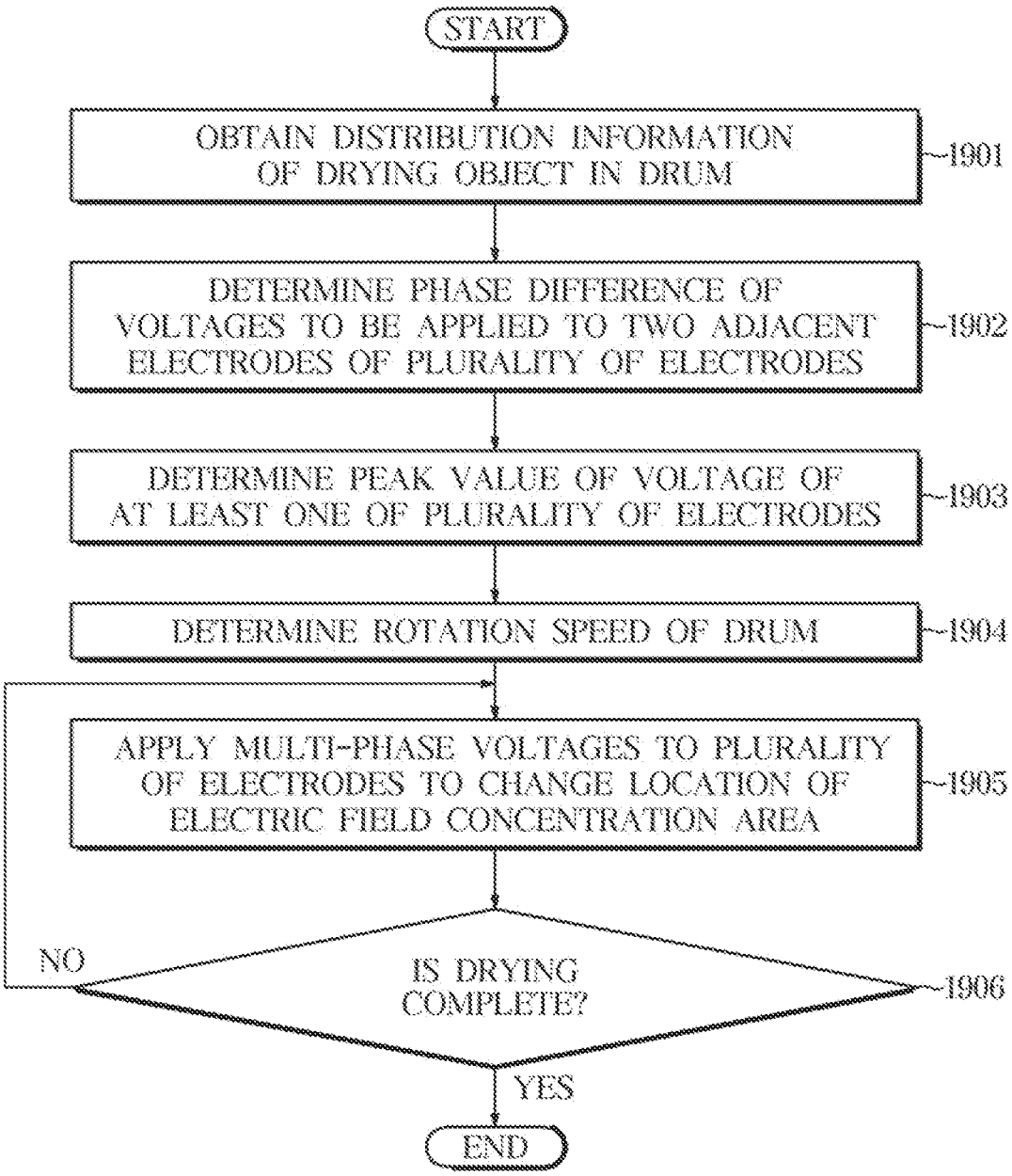
FIG. 20 is a flowchart illustrating an extended embodiment of the method for controlling the dryer of FIG. 19.

FIG. 20 is a flowchart illustrating an extended embodiment of the method for controlling the dryer described in FIG. 19.

Referring to FIG. 20, the controller 200 of the dryer 1 may obtain distribution information of a drying object in the drum 20 (operation 1901). The operation 1901 corresponds to the operation 1701 described with reference to FIG. 19. Based on the distribution information of the drying object, the controller 200 may determine a phase difference of voltages to be applied to each of two adjacent electrodes from among the plurality of electrodes 90 (operation 1902). The operation 1902 corresponds to the operation 1702 described with reference to FIG. 19.

The controller 200 may determine a peak value of a voltage of at least one from among the plurality of electrodes 90 (operation 1903). For example, the controller 200 may control the DC power supply 110 to increase the peak value of the voltage of at least one from among the plurality of electrodes 90 based on a location of the drying object and the amount of the drying object. The controller 200 may adjust a strength of an electric field with respect to at least a portion of an inner space of the drum 20. By adjusting the peak value of the voltage applied to the electrodes, a size of an electric field concentration area may be adjusted. The size of the electric field concentration area may change dynamically in response to movement of the drying object by rotation of the drum 20.

The controller 200 may determine (e.g., set) a rotation speed of the drum 20 (operation 1904). For example, in a case where a plurality of relatively lightweight drying objects are identified as being distributed at different locations in the drum 20, the controller 200 may determine the rotation speed of the drum 20 to be relatively high in order to prevent the plurality of drying objects from clumping and to increase a dielectric heating efficiency. In a case where a relatively heavy drying object is identified as being located in one area in the drum 20, the controller 200 may determine the rotation speed of the drum 20 to be relatively low.

The controller 200 may apply multi-phase voltages to the plurality of electrodes 90 to change a location of the electric field concentration area in response to the rotation of the drum 20 (operation 1905). The operation 1905 corresponds to the operation 1703 described with reference to FIG. 19. The location of the electric field concentration area may change dynamically in response to movement of the drying object by the rotation of the drum 20.

The controller 200 may determine whether the drying is complete (operation 1906). The controller 200 may apply multi-phase voltages to the plurality of electrodes 90 until the drying is complete. Once the drying is complete, the controller 200 may control the RF power supply 120 to not apply voltage to the plurality of electrodes 90.

As such, the dryer 1 according to an embodiment of the present disclosure may improve the drying efficiency by dielectric heating, by changing the location and size of the electric field concentration area in response to the rotation of the drum 20 and the movement of the drying object.

According to an embodiment of the present disclosure, a dryer 1 may include: a cabinet 1*a*; a drum 20 configured to rotate in the cabinet; a plurality of electrodes 90, between the drum and the cabinet, that are spaced apart from each other along a circumference of the drum; an RF power supply 120 configured to apply a voltage to the plurality of electrodes; and a controller 200 configured to control the RF power supply to generate an electric field, via the plurality of electrodes, for dielectric heating of an object to be dried in the drum.

The controller may be configured to obtain distribution information of the object in the drum based on at least one from among a vibration pattern of the drum and magnitudes of voltages detected at each of the plurality of electrodes. The controller may be configured to determine a phase difference of voltages to be applied to each of two adjacent electrodes from among the plurality of electrodes based on the distribution information of the object. The controller may be configured to control the RF power supply to apply multi-phase voltages to the plurality of electrodes, based on the phase difference of the voltages applied to the each of the two adjacent electrodes.

The controller may be configured to adjust the phase difference of the voltages to be applied to the each of the two adjacent electrodes, based on changes in the distribution information of the object as drying of the object is performed.

The controller may be configured to increase the phase difference of the voltages to be applied to the each of the two adjacent electrodes, as distribution of the object is concentrated on an inner wall of the drum.

The controller may be configured to determine a minimum value of the phase difference of the voltages to be applied to the each of the two adjacent electrodes based on a number of the plurality of electrodes. The controller may be configured to determine the phase difference as an integer multiple of the minimum value based on the distribution information of the object.

The controller may be configured to determine the phase difference of the voltages to be applied to the each of the two adjacent electrodes such that the controller causes, via control of the RF power supply, a plurality of electric field concentration areas to be simultaneously generated in the drum based on the distribution information of the object to be dried.

The dryer 1 may further include a direct current (DC) power supply configured to supply a DC power to the RF power supply. The controller may be configured to control the DC power supply to adjust a peak value of voltages applied to the plurality of electrodes based on the distribution information of the object.

The controller may be configured to control the DC power supply to increase a peak value of a voltage of at least one from among the plurality of electrodes based on a location of the object and an amount of the object.

The distribution information of the object may include the location of the object to be dried and the amount of the object in the drum. The controller may be configured to determine the location of the object and the amount of the object in the drum, based on a difference between a magnitude of a predetermined reference voltage and the detected magnitude of the voltage.

The controller may be configured to determine that the amount of the object is larger, as the difference between the magnitude of the predetermined reference voltage and the detected magnitude of the voltage increases.

The controller may be configured to determine a rotation speed of the drum based on the distribution information of the object.

According to an embodiment of the present disclosure, a method for controlling a dryer may include: obtaining, by a controller, distribution information of an object to be dried in a drum based on at least one from among a vibration pattern of the drum and magnitudes of voltages detected at each of a plurality of electrodes; determining, by the controller, a phase difference of voltages to be applied to each of two adjacent electrodes from among the plurality of electrodes based on the distribution information of the object; and controlling an RF power supply to apply multiphase voltages to the plurality of electrodes, based on the phase difference of the voltages to be applied to the two adjacent electrodes, so as to generate an electric field for dielectric heating of the object while the drum rotates.

The determining of the phase difference may include adjusting the phase difference of the voltages to be applied to the each of the two adjacent electrodes, based on changes in the distribution information of the object as drying of the object is performed.

The adjusting of the phase difference may include increasing the phase difference of the voltages to be applied to the each of the two adjacent electrodes, as distribution of the object is concentrated on an inner wall of the drum.

The determining of the phase difference may include determining a minimum value of the phase difference of the voltages to be applied to the each of the two adjacent electrodes based on a number of the plurality of electrodes, and determining the phase difference as an integer multiple of the minimum value based on the distribution information of the object.

The phase difference of the voltages to be applied to each of the two adjacent electrodes may be determined such that the controlling the RF power supply comprising controlling the RF power supply such as to simultaneously generate a plurality of electric field concentration areas in the drum, based on the distribution information of the object.

According to an embodiment of the present disclosure, the method for controlling the dryer may further include controlling a DC power supply, configured to supply a DC power to the RF power supply, to adjust a peak value of voltages applied to the plurality of electrodes based on the distribution information of the object.

The adjusting of the peak value of the voltages applied to the plurality of electrodes may include increasing a peak value of a voltage of at least one from among the plurality of electrodes.

The obtaining of the distribution information of the object may include determining a location of the object and an amount of the object in the drum, based on a difference between a magnitude of a predetermined reference voltage and the detected magnitude of the voltage.

It may be determined that the amount of the object is larger, as the difference between the magnitude of the predetermined reference voltage and the detected magnitude of the voltage increases.

According to an embodiment of the present disclosure, the method for controlling the dryer may further include determining a rotation speed of the drum based on the distribution information of the object.

According to embodiments of the present disclosure, a dryer and a method for controlling the same may change a location of an electric field concentration area for dielectric heating by monitoring a distribution of an object to be dried in a drum. In addition, the dryer and the method for controlling the same may generate at least one electric field concentration area and may adjust a size of the at least one electric field concentration area in consideration of the amount of the object, a movement of the object, and an eccentricity of the object. Thus, a drying efficiency by dielectric heating may be improved.

Embodiments of the present disclosure may be implemented in the form of a recording medium that stores instructions executable by a computer. The instructions may be stored in the form of program codes, and when executed by a processor, the instructions may generate a program module to perform operations of the embodiments.

The machine-readable recording medium may be provided in the form of a non-transitory storage medium. The term "non-transitory storage medium" may mean a tangible device without including a signal (e.g., electromagnetic waves) and may not distinguish between storing data in the storage medium semi-permanently and temporarily. For example, the non-transitory storage medium may include a buffer that temporarily stores data.

Methods according to various embodiments of the present disclosure may be provided in a computer program product. The computer program product may be a commercial product that may be traded between a seller and a buyer. The computer program product may be distributed in the form of a storage medium (e.g., compact disc read only memory (CD-ROM)), through an application store (e.g., Play Store™), directly between two user devices (e.g., smartphones), or online (e.g., downloaded or uploaded). In the case of online distribution, at least part of the computer program product (e.g., a downloadable app) may be at least temporarily stored or arbitrarily generated in a storage medium that may be readable to a device, such as a server of the manufacturer, a server of the application store, or a relay server.

Although non-limiting example embodiments have been shown and described in the present disclosure, it would be appreciated by those skilled in the art that changes and modifications may be made in these embodiments without departing from the spirit and scope of the present disclosure.

What is claimed is:

1. A dryer, comprising:

a cabinet;

a drum configured to rotate in the cabinet;

a plurality of electrodes, between the drum and the cabinet, that are spaced apart from each other along a circumference of the drum;

a radio frequency (RF) power supply configured to apply a voltage to the plurality of electrodes; and a controller configured to control the RF power supply to generate an electric field, via the plurality of electrodes, for dielectric heating of an object to be dried in the drum, wherein the controller is configured to:

obtain distribution information of the object in the drum based on at least one from among a vibration pattern of the drum and magnitudes of voltages detected at each of the plurality of electrodes, determine a phase difference of voltages to be applied to each of two adjacent electrodes from among the plurality of electrodes based on the distribution information of the object, and control the RF power supply to apply multi-phase voltages to the plurality of electrodes, based on the phase difference of the voltages applied to the each of the two adjacent electrodes.

2. The dryer of claim 1, wherein the controller is configured to adjust the phase difference of the voltages to be applied to the each of the two adjacent electrodes, based on changes in the distribution information of the object as drying of the object is performed.

3. The dryer of claim 2, wherein the controller is configured to increase the phase difference of the voltages to be applied to the each of the two adjacent electrodes, as distribution of the object is concentrated on an inner wall of the drum.

4. The dryer of claim 1, wherein the controller is configured to determine a minimum value of the phase difference of the voltages to be applied to the each of the two adjacent electrodes based on a number of the plurality of electrodes, and determine the phase difference as an integer multiple of the minimum value based on the distribution information of the object.

5. The dryer of claim 1, wherein the controller is configured to determine the phase difference of the voltages to be applied to the each of the two adjacent electrodes such that the controller causes, via control of the RF power supply, a plurality of electric field concentration areas to be simultaneously generated in the drum based on the distribution information of the object.

6. The dryer of claim 1, further comprising:

a direct current (DC) power supply configured to supply a DC power to the RF power supply, wherein the controller is configured to control the DC power supply to adjust a peak value of voltages applied to the plurality of electrodes based on the distribution information of the object.

7. The dryer of claim 6, wherein the controller is configured to control the DC power supply to increase a peak value of a voltage of at least one from among the plurality of electrodes based on a location of the object and an amount of the object.

8. The dryer of claim 1, wherein the distribution information of the object comprises a location of the object and an amount of the object in the drum, and the controller is configured to determine the location of the object and the amount of the object in the drum, based on a difference between a magnitude of a predetermined reference voltage and a detected magnitude of one of the voltages.

9. The dryer of claim 8, wherein the controller is configured to determine that the amount of the object is larger, as the difference between the magnitude of the predetermined reference voltage and the detected magnitude of the one of the voltages increases.

10. The dryer of claim 1, wherein the controller is configured to determine a rotation speed of the drum based on the distribution information of the object.

11. A method for controlling a dryer including a cabinet, a drum in the cabinet, a plurality of electrodes between the drum and the cabinet, a radio frequency (RF) power supply configured to apply a voltage to the plurality of electrodes, and a controller, the method comprising:

obtaining, by the controller, distribution information of an object to be dried in the drum based on at least one from among a vibration pattern of the drum and magnitudes of voltages detected at each of the plurality of electrodes;

determining, by the controller, a phase difference of voltages to be applied to each of two adjacent electrodes from among the plurality of electrodes based on the distribution information of the object, and controlling the RF power supply to apply multi-phase voltages to the plurality of electrodes, based on the phase difference of the voltages to be applied to the two adjacent electrodes, so as to generate an electric field for dielectric heating of the object while the drum rotates.

12. The method of claim 11, wherein the determining of the phase difference comprises adjusting the phase difference of the voltages to be applied to the each of the two adjacent electrodes, based on changes in the distribution information of the object as drying of the object is performed.

13. The method of claim 12, wherein the adjusting of the phase difference comprises increasing the phase difference of the voltages to be applied to the each of the two adjacent electrodes, as distribution of the object is concentrated on an inner wall of the drum.

14. The method of claim 11, wherein the determining of the phase difference comprises:

determining a minimum value of the phase difference of the voltages to be applied to the each of the two adjacent electrodes based on a number of the plurality of electrodes; and determining the phase difference as an integer multiple of the minimum value based on the distribution information of the object.

15. The method of claim 11, wherein the phase difference of the voltages to be applied to the each of the two adjacent electrodes is determined such that the controlling the RF power supply comprising controlling the RF power supply such as to simultaneously generate a plurality of electric field concentration areas in the drum, based on the distribution information of the object.

16. A non-transitory computer-readable medium storing computer instructions that are configured to, when executed by at least one processor, cause the at least one processor to:

control a dryer that includes a cabinet, a drum in the cabinet, a plurality of electrodes between the drum and the cabinet, and a radio frequency (RF) power supply configured to apply a voltage to the plurality of electrodes, wherein the computer instructions are configured to cause the at least one processor to control the dryer by:

obtaining distribution information of an object to be dried in the drum based on at least one from among a vibration pattern of the drum and magnitudes of voltages detected at each of the plurality of electrodes;

determining a phase difference of voltages to be applied to each of two adjacent electrodes from among the plurality of electrodes based on the distribution information of the object, and controlling the RF power supply to apply multi-phase voltages to the plurality of electrodes, based on the phase difference of the voltages to be applied to the two adjacent electrodes, so as to generate an electric field for dielectric heating of the object while the drum rotates.

17. The non-transitory computer-readable medium of claim 16, wherein the computer instructions are configured to cause the at least one processor to adjust the phase difference of the voltages to be applied to the each of the two adjacent electrodes, based on changes in the distribution information of the object as drying of the object is performed.

18. The non-transitory computer-readable medium of claim 17, wherein the computer instructions are configured to cause the at least one processor to adjust the phase difference by increasing the phase difference of the voltages to be applied to the each of the two adjacent electrodes, as distribution of the object is concentrated on an inner wall of the drum.

19. The non-transitory computer-readable medium of claim 16, wherein the computer instructions are configured to cause the at least one processor to:

determine a minimum value of the phase difference of the voltages to be applied to the each of the two adjacent electrodes based on a number of the plurality of electrodes; and determine the phase difference as an integer multiple of the minimum value based on the distribution information of the object.

20. The non-transitory computer-readable medium of claim 16, wherein the computer instructions are configured to cause the at least one processor to determine the phase difference of the voltages to be applied to the each of the two adjacent electrodes such that the RF power supply is controlled, by the at least one processor, such as to simultaneously generate a plurality of electric field concentration areas in the drum, based on the distribution information of the object.

* * * * *